US011740042B2

(12) United States Patent
Kingsbury et al.

(10) Patent No.: US 11,740,042 B2
(45) Date of Patent: Aug. 29, 2023

(54) GAS TUBE SUPPORTS FOR POST BARREL PLENUM OPERATED GAS CYCLING SYSTEM FOR AUTOMATIC FIREARMS

(71) Applicant: RHINO PRECISION, LLC, Dripping Spring, TX (US)

(72) Inventors: Klint Mclean Kingsbury, Dripping Springs, TX (US); Clayton Warren Reinarz, New Braunfels, TX (US); Ronald Christopher Snider, New Braunfels, TX (US)

(73) Assignee: RHINO PRECISION, LLC, Dripping Spring, TX (US)

( * ) Notice: Subject to any disclaimer, the term of this patent is extended or adjusted under 35 U.S.C. 154(b) by 0 days.

(21) Appl. No.: 16/686,930

(22) Filed: Nov. 18, 2019

(65) Prior Publication Data

US 2020/0263943 A1 Aug. 20, 2020

Related U.S. Application Data

(60) Continuation-in-part of application No. 16/149,040, filed on Oct. 1, 2018, now Pat. No. 10,488,130, which is a division of application No. 14/681,031, filed on Apr. 7, 2015, now abandoned.

(60) Provisional application No. 61/975,987, filed on Apr. 7, 2014.

(51) Int. Cl.
*F41A 5/26* (2006.01)
*F41A 5/28* (2006.01)

(52) U.S. Cl.
CPC .. *F41A 5/26* (2013.01); *F41A 5/28* (2013.01)

(58) Field of Classification Search
CPC ..... F41A 3/54; F41A 3/62; F41A 5/00; F41A 5/18; F41A 5/20; F41A 5/24; F41A 5/26; F41A 5/28; F41A 5/30
USPC ..... 89/191.01, 191.02, 193, 194
See application file for complete search history.

(56) References Cited

U.S. PATENT DOCUMENTS

| | | | |
|---|---|---|---|
| 1,877,118 | A | 9/1932 | Barnes |
| 1,901,138 | A | 3/1933 | Barnes |
| 2,150,161 | A | 3/1939 | Green |
| 2,356,728 | A | 8/1944 | Reising |
| 2,951,424 | A | 9/1960 | Stoner |
| 3,776,093 | A | 12/1973 | Leverance |
| 4,454,798 | A | 6/1984 | Shea |
| 4,576,083 | A | 3/1986 | Seberger, Jr. |
| 4,813,333 | A | 3/1989 | Garris |
| 4,907,488 | A | 3/1990 | Seberger |
| 5,679,916 | A | 10/1997 | Weichert |
| 5,831,202 | A | 11/1998 | Rustick |
| 6,308,609 | B1 | 10/2001 | Davies |

(Continued)

*Primary Examiner* — Jonathan C Weber
(74) *Attorney, Agent, or Firm* — Wood Herron & Evans LLP

(57) ABSTRACT

A gas tube support system for a gas-actuated firearm contains an annular or bored housing for receipt of a gas tube therein, thereby securing the gas tube during operation of the firearm. At least one or more bores are drilled or formed within the annular or bored housing to provide an impingement of the gas tube as it extends through the annular or bored housing. One or more fasteners are threadedly or otherwise received within a corresponding one of one or more respective bores, thereby securing the gas tube within the annular or bored housing. A gas-actuated firearm containing the gas tube support system is also provided.

10 Claims, 25 Drawing Sheets

(56) References Cited

U.S. PATENT DOCUMENTS

| | | | | |
|---|---|---|---|---|
| 6,374,718 | B1 | 4/2002 | Rescigno et al. | |
| 7,237,467 | B1 | 7/2007 | Melton | |
| 7,856,917 | B2 | 12/2010 | Noveske | |
| 7,891,284 | B1 | 2/2011 | Barrett | |
| 7,946,214 | B2 | 5/2011 | Stone | |
| 8,104,570 | B2 | 1/2012 | Miller | |
| 8,316,756 | B1 * | 11/2012 | Woodell | F41A 5/28 89/193 |
| 8,528,458 | B2 | 9/2013 | Windauer | |
| 9,103,618 | B2 | 8/2015 | Daniel | |
| 2005/0115398 | A1 | 6/2005 | Olson | |
| 2007/0107590 | A1 | 5/2007 | Silvers | |
| 2012/0167756 | A1 | 7/2012 | Larue | |
| 2012/0167757 | A1 | 7/2012 | Gomez | |
| 2013/0291713 | A1 | 11/2013 | Zheng | |
| 2014/0033590 | A1 * | 2/2014 | Gomez | F41A 21/48 42/75.02 |
| 2014/0190345 | A1 | 7/2014 | Daniel | |
| 2015/0184960 | A1 | 7/2015 | Monveldt | |
| 2015/0260472 | A1 | 9/2015 | Smith | |
| 2017/0108303 | A1 * | 4/2017 | Gomez | F41A 5/26 |

* cited by examiner

GAS TUBE SUPPORTS FOR POST BARREL PLENUM OPERATED GAS CYCLING SYSTEM FOR AUTOMATIC FIREARMS

CROSS REFERENCES TO RELATED APPLICATIONS

This application is a Continuation-in-Part of co-pending U.S. patent application Ser. No. 16/149,040, filed Oct. 1, 2018, which is a Divisional of U.S. patent application Ser. No. 14/681,031, filed Apr. 7, 2015, now abandoned, which claims the benefit of U.S. Provisional Patent Application 61/975,987, filed Apr. 7, 2014, the full disclosures of which are incorporated herein by reference.

FIELD OF THE INVENTION

The present invention relates generally to firearms and more specifically to automatic gas-operated firearms. The present invention provides a gas buffer plenum at the end of a firearm barrel that stores and directs high pressure gas through a gas tube to the receiver of the firearm in order to cycle the bolt after the bullet has left contact with the barrel rifling.

BACKGROUND

Most currently available automatic gas operated firearms have a barrel with a small hole drilled vertically into the barrel to allow gas to escape up into a gas block. This vertical hole and gas block are typically located midway down the barrel. As a round is fired, the explosion forces the bullet down the barrel and past this small hole. As the bullet passes the hole, the still burning gun powder and gas are forced up through the small hole and into the gas block which directs the burning powder and gas in the opposite direction down a gas tube and back into the receiver of the firearm. Inside the receiver, the burning powder and gas impact the bolt and force it backwards to eject the spent round casing and load the next round. The balance of the burning powder and gas continue their reaction and expand down the remainder of the barrel, forcing the bullet out of the end and on down range.

Four issues result from the above described process. First, the small vertical port hole creates an inconsistency in the bullet path that can add vibration to the bullet. Vibration degrades accuracy. Second, the gas pulled from the barrel to cycle the bolt generates reduced and inconsistent gas pressure on the bullet as the bolt opens while the bullet is still in contact with the barrel rifling. This reduces velocity and also degrades accuracy. Third, due to the midpoint position of the vertical port hole, the powder from the round is not completely burned up inside the barrel. As such, unburnt powder enters into the gas tube and thereafter into the receiver and into the bolt mechanism. This unburnt powder can cause the bolt mechanism to foul faster and require more frequent cleaning for proper function. Fourth, the gas forces on the bolt vary greatly depending on port hole size, port hole position, and the length of the barrel. Therefore, for a given round and the same gas block, a short barrel might not correctly cycle the round while a longer barrel would, or the reverse could be true. This last issue creates the need for adjustable gas blocks that must be tuned precisely for each type of round.

SUMMARY

The present invention does not require a vertical port hole in the barrel. This eliminates the inconsistency in the barrel and reduces bullet vibration, thus adding accuracy. The gas port hole is instead located in the buffer plenum of the present invention, past the end of the barrel rifling. The bullet leaves the rifling before the gas enters the plenum and is thereafter directed down the gas tube. The bullet is no longer in contact with rifling when the gas is drawn away and directed to the receiver and bolt. The bolt starts to open after the bullet is out of rifling contact. This allows for consistent gas pressure on the bullet throughout barrel travel on every shot. Consistent gas pressure generates increased and consistent velocity and thus adds accuracy. Because the gas port hole is located in the buffer plenum of the present invention, past the end of the rifling, the system allows for more of the powder to be burned before it is directed to the bolt. This reduces fouling and allows for longer operation between cleanings.

The buffer plenum of the present invention has multiple chambers. This causes the plenum to act like a capacitor as the bullet travels through. The multiple chambers store pressure that is consistently applied into the gas tube and to the bolt as the bullet passes through the chambers. This greatly reduces cycling issues with different rounds and barrel lengths. The end of barrel gas buffer plenum of the present invention is an improvement on the typical gas cycling mechanism for automatic firearms. Current gas operated repeating firearms do not offer the same accuracy and velocity as do bolt action firearms. The present invention allows the same or similar accuracy and velocity from a gas operated repeating firearm as that of a bolt action firearm. The system of the present invention further helps reduce the amount of fouling of the bolt as occurs in other gas operated firearms.

The structure of the preferred embodiment of the device of the present invention broadly comprises the following: a barrel side end cap; a target side end cap; a plenum tube or cylinder; at least one chamber wall; and a gas tube hole connected to a return gas tube. The barrel side end cap is designed to be affixed to the end of a rifled gun barrel. The device may be affixed to the barrel by any method, not limited to the following: threaded, welded, bolted, snap-on, quick attach, clamp etc. The barrel side end cap may be fabricated from, but not limited to, steel, stainless steel, titanium, aluminum, polymer, ceramic, Inconel, etc. The barrel side end cap also allows for the bullet to pass through without contact and thereafter enter into the buffer plenum enclosure. The barrel side end cap preferably has a hole in the center with a diameter that allows for connection to the barrel and for the bullet to pass through without contact.

The target side end cap of the present invention is designed to allow the bullet to leave the buffer plenum and retain as much gas as possible in the plenum enclosure without contacting the bullet. The diameter of the central hole in the target side end cap should be as close to the bullet diameter as possible without allowing contact with the bullet as it passes through. This ensures as much gas pressure as possible is retained in the plenum for as long as possible. Avoiding contact with the bullet ensures maximum accuracy. The target side end cap may be attached to the rest of the plenum assembly by any method, not limited to the following: threaded, welded, bolted, snap-on, quick attach, clamp etc. The target side end cap may be fabricated from, but not limited to, steel, stainless steel, titanium, aluminum, polymer, ceramic, Inconel, etc.

The plenum tube of the present invention connects and aligns the barrel side end cap with the target side end cap. The plenum tube or cylinder wall is designed to keep the barrel side end cap concentric with the target side end cap.

This ensures that the projectile holes are perfectly aligned with the barrel so that the bullet does not impact the plenum. The plenum tube also holds in position the one or more chamber walls. The plenum tube may be attached to the rest of the plenum assembly by any method, not limited to the following: threaded, welded, bolted, snap-on, quick attach, clamp etc. The plenum tube may be fabricated from, but not limited to steel, stainless steel, titanium, aluminum, polymer, ceramic, Inconel, etc.

The one or more chamber walls create multiple small chambers inside the buffer plenum. The chamber walls are designed to fit concentrically inside the plenum tube. The chamber walls each also have a center hole designed to be just slightly larger than the bullet diameter. The bullet should pass through this hole without making contact. The preferred embodiment of the present invention consists of multiple chamber walls. Creating multiple chambers allows the buffer plenum to act as a capacitor and store the gas charge to create continuous effective bolt pressure. The chamber walls may be attached to the rest of the plenum assembly by any method, not limited to the following: pressure fit, threaded, welded, bolted, snap-on, quick attach, clamp etc. The chamber walls may be fabricated from, but not limited to, steel, stainless steel, titanium, aluminum, polymer, ceramic, Inconel, etc.

A gas tube hole is configured in the barrel side end cap. This gas tube hole receives, retains, and supports the gas tube. As the bullet enters the buffer plenum, the gas pressure in the plenum escapes through the gas tube hole and into the gas tube where it passes on to the bolt mechanism and cycles the firearm. The gas tube hole may alternately be connected to a piston system for a hard linkage to the bolt. The gas tube hole may be produced by, but not limited to drilling.

The gas buffer plenum may, in an alternate embodiment, be formed from the barrel stock. A suitable barrel could be counter bored to form the plenum tube and thereby eliminate the barrel side end cap. The plenum tube is preferably connected to the barrel side end cap in one of the following ways, but not limited to: threaded on, pressure fit, clamped, bolted, welded, quick attach, snap on, etc. This interface must be precise so that the plenum tube and the barrel side end cap maintain concentricity. The barrel side end cap and the plenum tube may also be formed from the same piece of material and made monolithic.

The chamber walls should be precisely held inside the plenum tube. They must be held so that they maintain concentricity between each other, the plenum tube, and the barrel side end cap. The number of chamber walls, and the size of the chambers will vary on caliber of the firearm and the optimization of the bolt cycling mechanism. The buffer plenum may preferably be constructed of one or more chambers. The chamber walls may be secured inside the plenum tube in the following ways, but not limited to: threaded on, pressure fit, clamped, bolted, welded, quick attach, snap on, etc.

The target side end cap is preferably connected to the plenum tube in the following ways, but not limited to: threaded on, pressure fit, clamped, bolted, welded, quick attach, snap on, etc. The plenum tube and the target side end cap may alternately be formed from one piece of material. The target side end cap must also be held in concentricity with the plenum tube. The center hole of the target side end cap must be sized to allow the bullet to pass through without contact, but with extremely tight clearance to catch as much gas as possible. The gas tube hole should be aligned with the gas tube of the firearm. Typically, this is vertically aligned, but this does not have to be the case. However, the gas tube hole must be aligned with the gas tube or the piston drive system so as to provide adequate gas flow back to the bolt for proper cycling.

In summary, the present invention provides a gas buffer plenum positioned at the end of the barrel of an automatic firearm. The barrel side end cap connects the system to the barrel. The plenum tube holds the chamber walls and retains the gas pressure. The target side end cap creates the final pressure chamber enclosure and is attached to the plenum tube to lock the system together. This gas buffer plenum allows the bullet to leave the barrel of the firearm before the bolt of the firearm starts to open. As the gas buffer plenum is filled with the exploding gas behind the bullet, the gas chambers build and maintain pressure that is then forced back through a hole in the plenum. The gas is forced down a gas tube or into a piston system. Depending on the configuration of the firearm, either the gas force, or the piston strikes the bolt and cycles the firearm. The gas buffer plenum may operate in semi-automatic or fully automatic function. The system may also be used to retrofit a gas operated firearm that uses a traditional gas block design.

The components of the system of the present invention could be reconfigured by changing the number of chamber walls in the assembly, and thus the length of the plenum tube. The plenum tube may also be eliminated, and the chamber walls may be fixed together in series by welding, bolting or threading so that they generate the same concentric line of chambers required for operation. The gas tube hole may be positioned in any chamber space from any direction. Repositioning of the gas tube hole to an alternate end cap or plenum tube location can change the aesthetics and the performance of the bolt cycling function. The components may also interface with a gas tube back to the bolt, or reconfigured with a piston shaft that contacts the bolt. The barrel of the firearm may itself be machined to eliminate the need for a barrel side end cap, with the plenum tube being formed as part of the barrel. The barrel could also have a gas tube gun drilled into it to transmit the gas back from the plenum tube.

The gas buffer plenum is preferably either installed on a new gas operated firearm or retrofitted to an existing gas operated firearm. The user aims this firearm at a target, removes the firearm safety, and pulls the trigger to fire. As the round fires, the exploding gas pressure forces the bullet down the barrel. As it exists the rifling, it enters into the gas buffer plenum. The gas pressure behind the bullet is transmitted into the chambers and forced back through the gas tube hole. The gas travels from the gas tube hole into the gas tube and back to the bolt in the receiver. The gas pressure forces the bolt open, but not until after the bullet has left contact with the barrel rifling. The bullet leaves the gas buffer plenum and precisely impacts the target. The user then depresses the trigger again to fire another shot, or may put the firearm back on safety and cease fire. In fully-automatic mode, the user could hold down the trigger and the firearm would continue to load and fire rounds automatically.

The end of barrel gas plenum of the present invention can not only be used as the gas operation system for a new firearm, it may also be used as a retrofit kit for existing firearms. The port hole of the barrel of an existing firearm can be plugged and the gas block removed. Alternately, the gas block may be turned so that it blocks the port hole in the barrel. Thereafter, the plenum of the present invention may be added to the end of the barrel. A longer gas tube may be connected between the receiver and the end of barrel gas plenum. Alternately, a piston system may be installed as the gas force transmission system.

The end of barrel gas buffer plenum may also be modified with additional baffles and materials to form an integrated suppressor. This would dramatically reduce the sound of the shot, and still function to cycle the firearm.

Any gas operated firearm could benefit from the present invention. The end of barrel gas buffer plenum may be designed onto the end of the barrel of any new firearm, and connected to the receiver with the standard gas tube or piston. Alternately, the plenum may be retrofitted to any existing gas operated firearm. The system would benefit by increased accuracy, cleaner operation and more robust cycling of the firearm.

In another aspect of the present invention, a gas tube support system contains an annular or bored housing for receipt of a gas tube therein, thereby securing the gas tube during operation of the firearm. At least one or more bores are drilled or formed within the annular or bored housing to provide an impingement of the gas tube as it extends through the annular housing. One or more set screws, roll pins, pins, or other fasteners are threadedly or otherwise received within a corresponding one of one or more respective bores, thereby fastening, securing, and/or fixing the gas tube within the annular or bored housing. One or more annular housings can be integrated with the barrel, such as a first exemplary system at the muzzle device/barrel or plenum/barrel junction, a second exemplary system at a receiver/gas tube junction, and/or a third exemplary system medially fixed along the barrel between the receiver and the muzzle device or plenum.

Accordingly, a gas-actuated firearm is provided that contains: a barrel having a barrel bore, a first (chamber) end, and a second (muzzle) end; a gas tube in fluid communication with the barrel upon firearm actuation, the gas tube having a third end and a fourth end; and a bored housing fixed to the firearm, wherein the gas tube extends through and is fixed within the bored housing such that neither the third end or the fourth end is within the bored housing.

In yet another aspect of the invention, a support system of a gas tube for a gas-actuated firearm is provided, wherein the support system includes a bored housing configured for attachment to the firearm, the bored housing containing a first bore defining at least one inner wall configured to contain a medial portion of a gas tube extending through the first bore and housing, and, configured to support and fix the medial portion of the tube therein.

Other aspects, features, benefits, and advantages of the present invention will become apparent to a person of skill in the art from the detailed description of various embodiments with reference to the accompanying drawing figures, all of which comprise part of the disclosure.

BRIEF DESCRIPTION OF THE DRAWINGS

Like reference numerals are used to indicate like parts throughout the various drawing figures, wherein.

DETAILED DESCRIPTION

Figure 1:
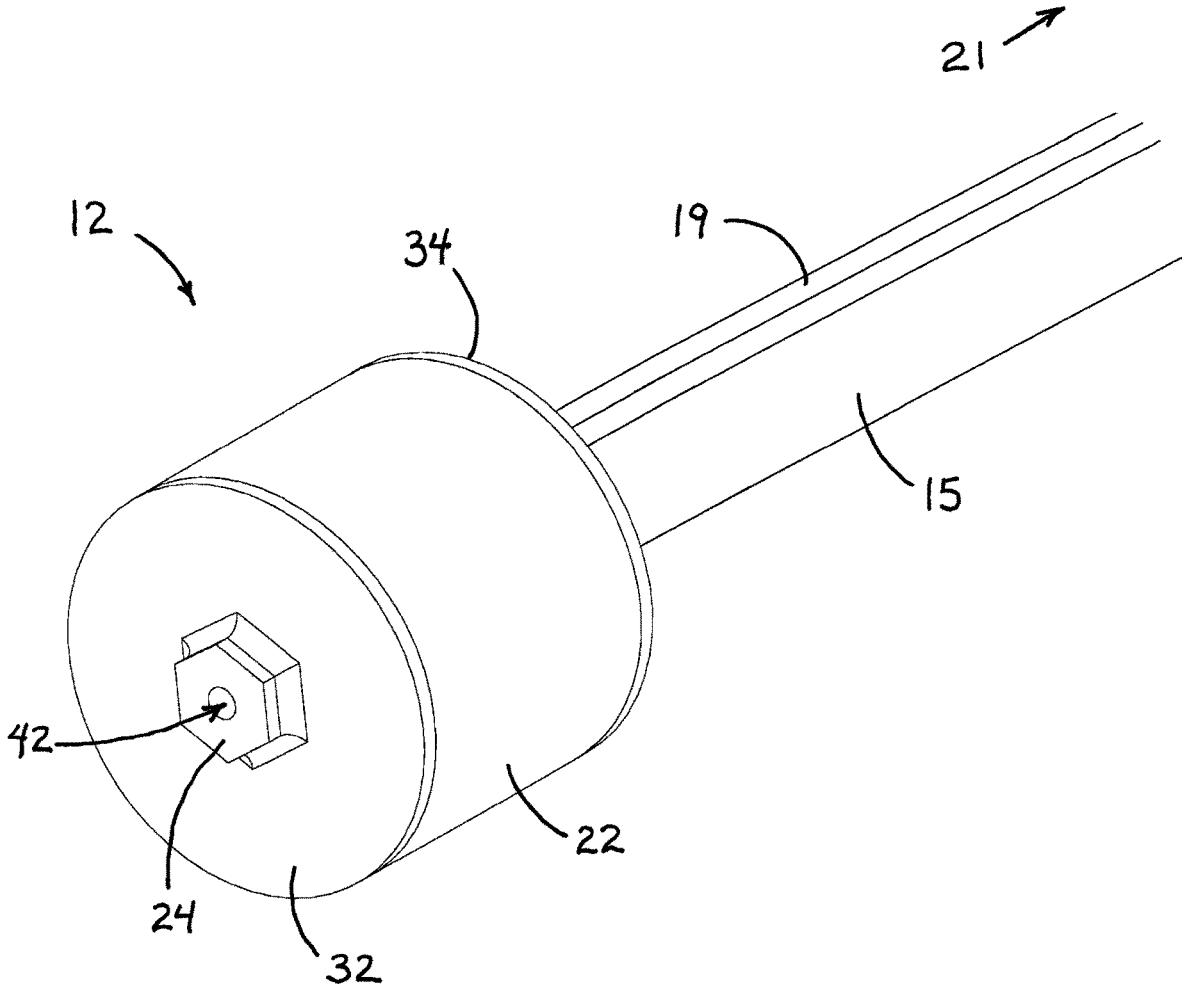
FIG. 1 is a perspective view of a first preferred implementation of the system of the present invention on a typical firearm barrel removed from the associated firearm for clarity.

With reference to the drawing figures, this section describes particular embodiments and their detailed construction and operation. Throughout the specification, reference to "one embodiment," "an embodiment," or "some embodiments" means that a particular described feature, structure, or characteristic may be included in at least one embodiment. Thus, appearances of the phrases "in one embodiment," "in an embodiment," or "in some embodiments" in various places throughout this specification are not necessarily all referring to the same embodiment. Furthermore, the described features, structures, and characteristics may be combined in any suitable manner in one or more embodiments. In view of the disclosure herein, those skilled in the art will recognize that the various embodiments can be practiced without one or more of the specific details or with other methods, components, materials, or the like. In some instances, well-known structures, materials, or operations are not shown or not described in detail to avoid obscuring aspects of the embodiments.

The term "forward" will indicate the direction of the muzzle and the direction in which projectiles are fired, while "rearward" will indicate the opposite direction. "Lateral" or "transverse" indicates a side-to-side direction generally perpendicular to the axis of the barrel. Although firearms may be used in any orientation, "left" and "right" will generally indicate the sides according to the user's orientation, "top" or "up" will be the upward direction when the firearm is gripped in the ordinary manner, and "bottom" or "down" will be the downward direction when the firearm is gripped in the ordinary manner. The term "medial" is meant to convey that any point between two ends of a component may constitute a medial, median, or middle position. The term "bore" is meant to convey a passage within an object, and, the passage may have an annular or tubular cross-section, or any other appropriate passage cross-section such as a non-tubular or non-annular cross-section. The term "bore" is further meant to convey, in a non-limiting way, that the "bored" passage may be drilled, punched, or otherwise formed in the respective component in a known manner.

Reference is made first to FIG. 1, which is a perspective view of a first preferred embodiment of the system of the present invention implemented on the end of a typical firearm barrel, removed from the associated firearm for clarity. A gas cycling system 10 in the first preferred embodiment includes an end of barrel gas buffer plenum 12 positioned on the end of a firearm barrel 16 and connected to the weapon receiver by way of a gas tube 19. The gas buffer plenum 12 is shown to generally comprise a plenum tube 22 with a target side end cap 32. Centered in the end cap 32 is a hexagonal shaped exit port 24 suitable for facilitating the rotation of the gas buffer plenum 12 onto the threaded end of a typical firearm barrel. The gas tube 18 shown in FIG. 1 extends from a return port (not seen in this view) positioned on the barrel side of the gas buffer plenum 12 and directs the collected pressurized gas from the gas buffer plenum 12 to conduct it back to the receiver of the weapon, whereby the high-pressure gas may serve to automatically activate the bolt of the firearm.

Figure 2A:
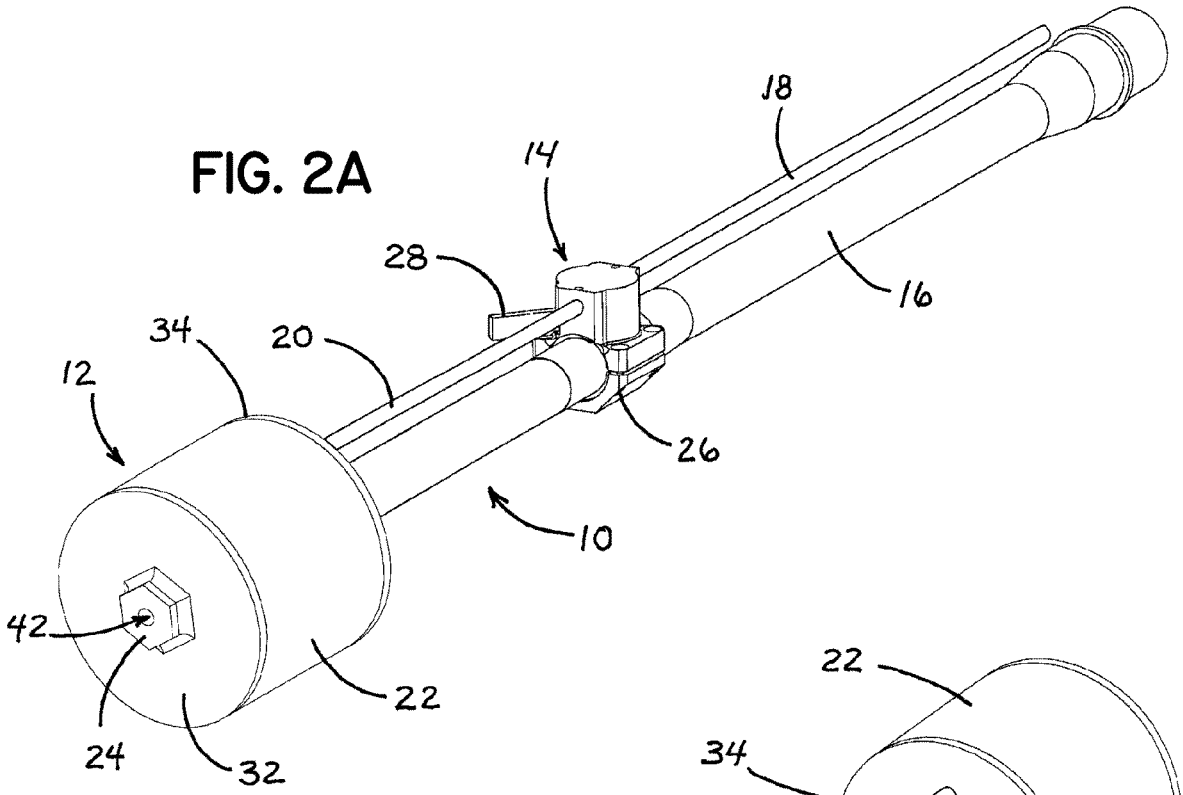
FIGS. 2A & 2B are perspective views of a second preferred implementation of the system of the present invention operable in association with a gas block valve positioned on the barrel.
Figure 2B:
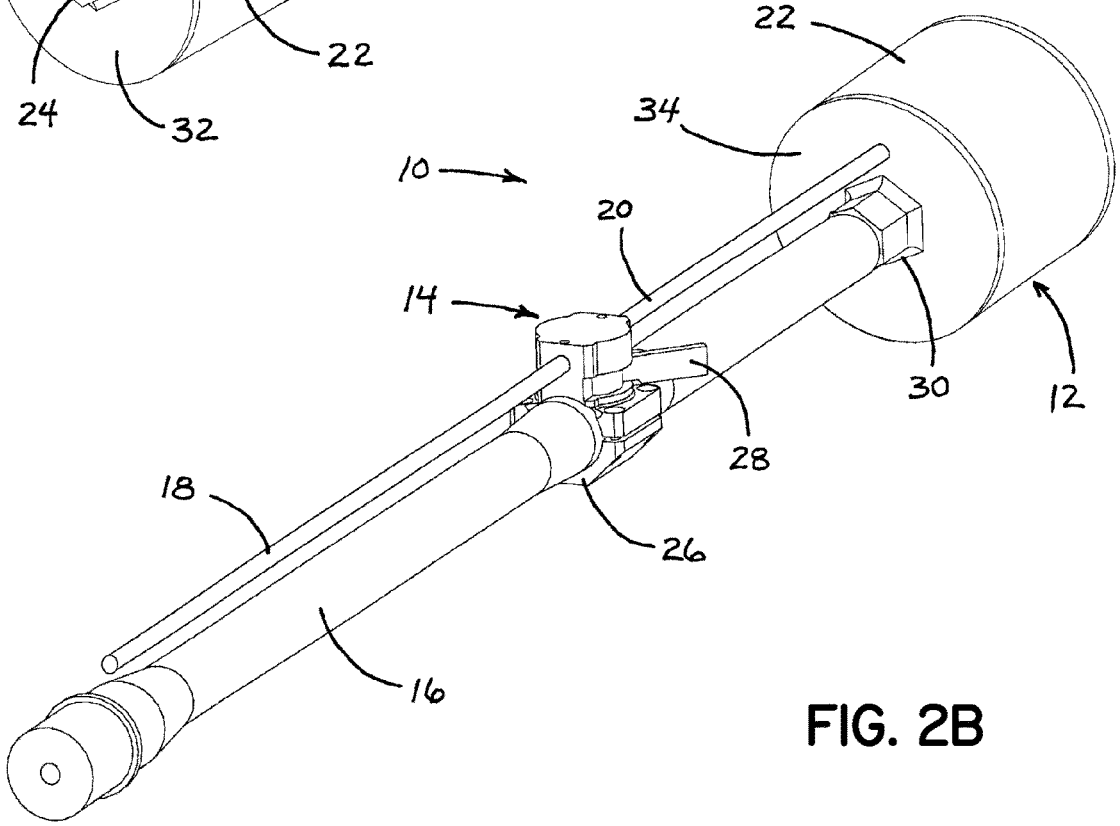

Reference is next made to FIGS. 2A and 2B which are perspective views of a second preferred embodiment of the system of the present invention implemented on a typical firearm barrel having an existing barrel gas port. The gas buffer plenum 12 is the same in this second embodiment and forms the primary component of the system of the present invention. In addition to the gas buffer plenum 12, however, a gas block valve 14 is positioned over an existing or drilled gas port in barrel 16. The gas tube 18 carries high pressure gas back from the gas port valve 14 to the receiver of the weapon. The gas tube 20 connects the gas buffer plenum 12 with the gas port valve 14. Operation of the gas port valve 14 by way of its attachment to the barrel 16, using a base half component 26, is achieved by movement of a valve lever 28 in a manner described in more detail below. FIG. 2A shows a target side perspective view of the system with a target side end cap 32 and an exit port 24. FIG. 2B provides a barrel side perspective view of the second preferred embodiment of the system of the present invention showing all of the same components as FIG. 2A, but additionally showing a barrel side end cap 34 and a hexagonal shaped barrel attachment fitting 30.

Figure 3:
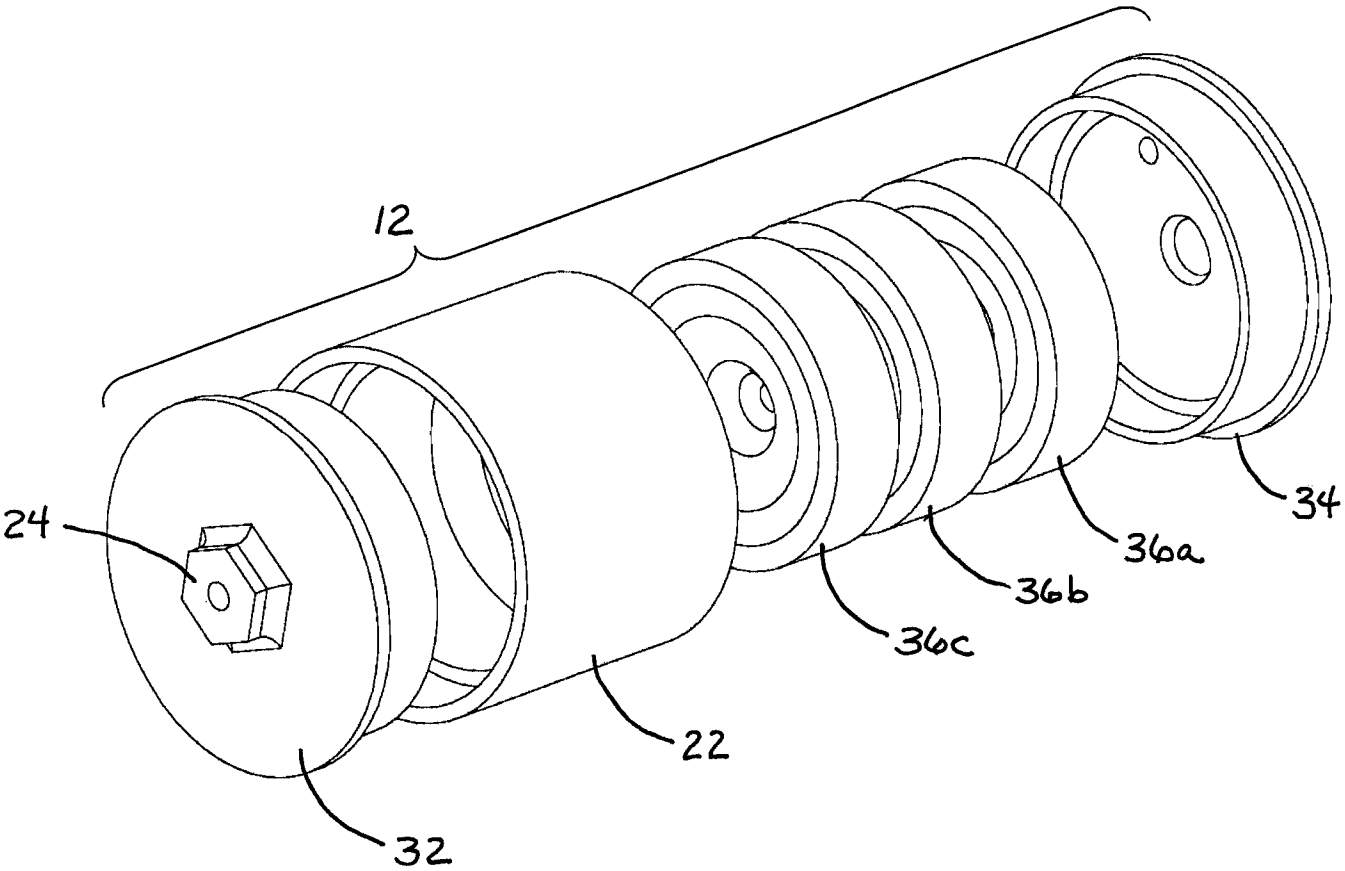
FIG. 3 is an exploded perspective view of the end of barrel gas buffer plenum of the present invention.

FIG. 3 is an exploded perspective view of the end of the barrel gas buffer plenum 12 of the present invention. In this view, the gas buffer plenum 12 is shown to be assembled along a single axis of each of the generally cylindrical or disc shaped components of the plenum 12. The view in FIG. 3 is from the target side of the plenum and includes the target side end cap 32 with an exit port 24. Providing the enclosing wall for the plenum is a plenum tube 22, which is a simple cylindrical wall with appropriately positioned end fittings to receive the target side end cap 32 and the barrel side end cap 34.

Positioned within the plenum tube 22, between the target side end cap 32 and the barrel side end cap 34, are one or more chamber walls 36A-36C. Depending upon the particular firearm to which the gas plenum is to be attached, the number of chamber walls 36 may vary from one to three or more. The greater number of chamber walls increases the collected high-pressure gas that is returned to affect the bolt action on the weapon that is desired. The preferred embodiment of the present invention shown in FIG. 3 includes three such chamber walls 36A, 36B, and 36C.

Figure 4:
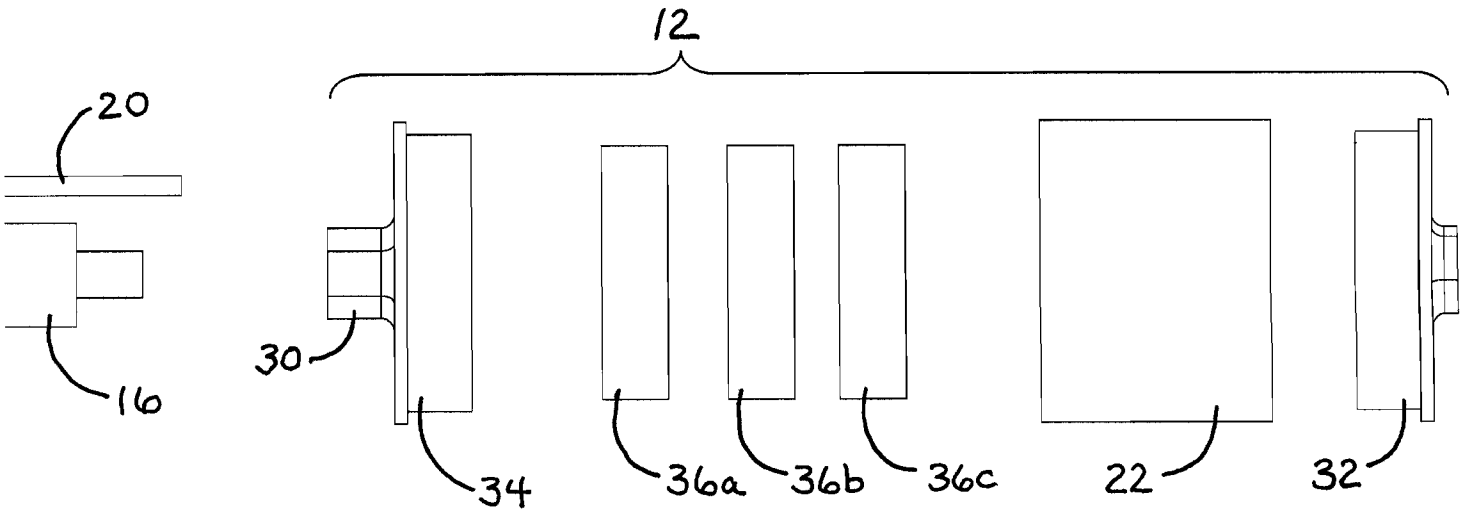
FIG. 4 is an exploded side view of the end of barrel gas buffer plenum of the present invention as shown in FIG. 3 and positioned adjacent the end of the barrel of the firearm.

FIG. 4 is an exploded side view of the end of a barrel gas buffer plenum of the present invention shown in FIG. 3 and positioned as it would be adjacent the end of the barrel of the firearm. In the view of FIG. 4, the barrel 16 is shown positioned parallel to the gas tube 20 where they would be connected to the barrel side end cap 34 by way of a barrel attachment fitting 30. One or more chamber wall components 36A-36C are shown positioned between the barrel side end cap 34 and the target side end cap 32. Surrounding the three chamber walls 36A-36C, and sized with fittings appropriate for receiving end caps 32 and 34, is the plenum tube 22. The manner in which each of these components is assembled to form the closed gas buffer plenum is described in more detail above.

Figure 5A:
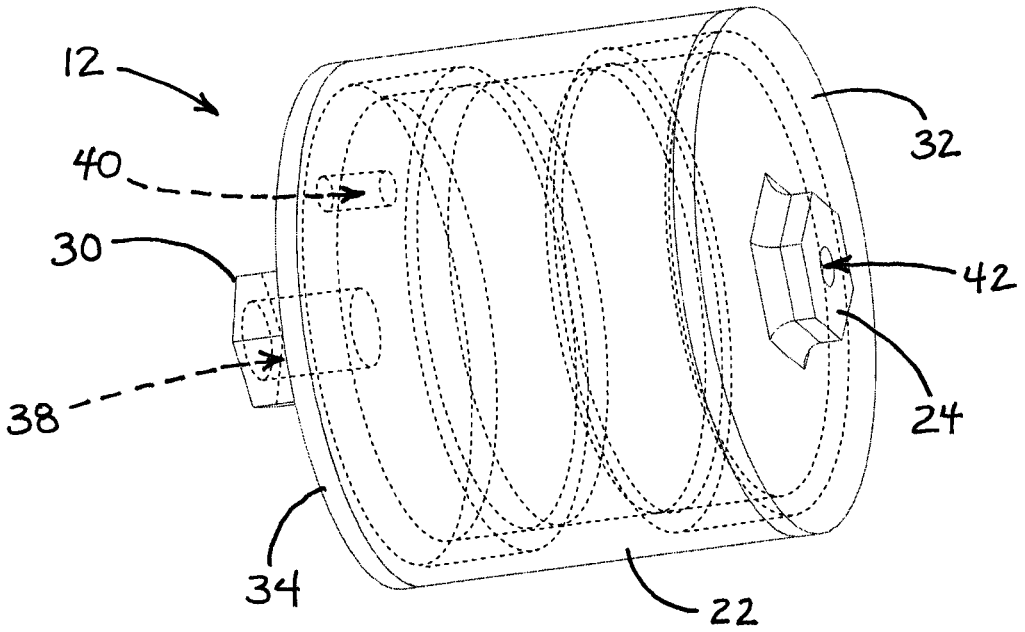
FIG. 5A is an assembled perspective view of the end of barrel gas buffer plenum of the present invention showing the internal positioning of the various components of the plenum.
Figure 5B:
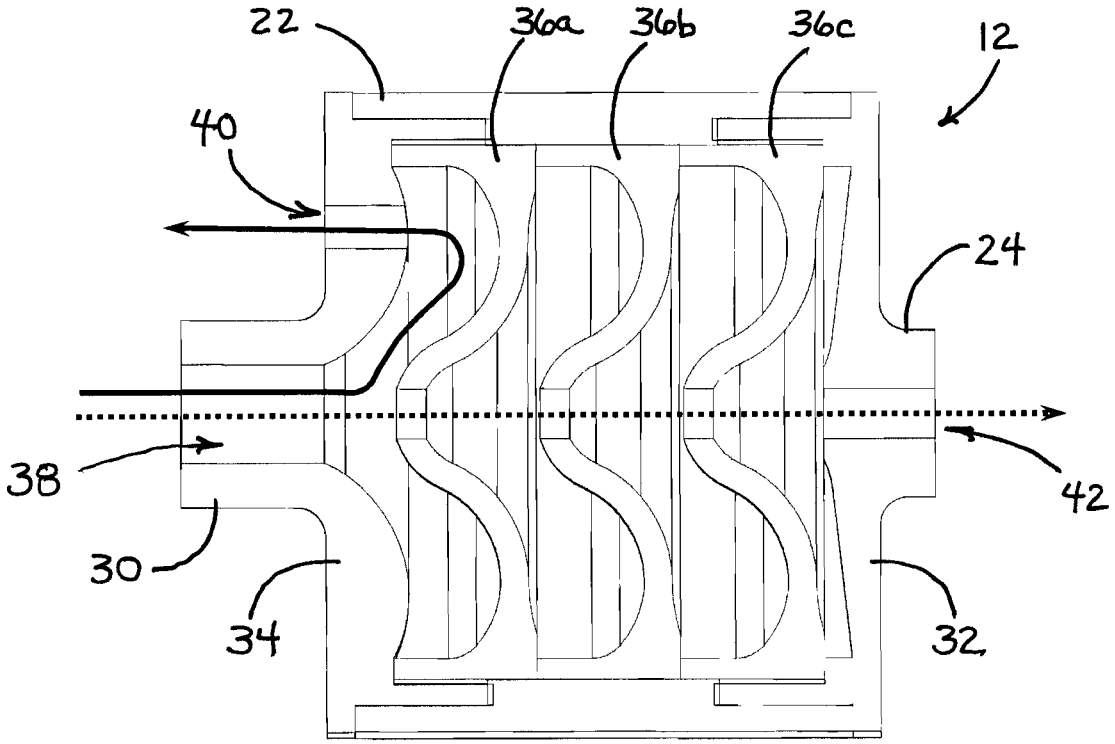
FIG. 5B is a cross-sectional side view of the end of barrel gas buffer plenum of the present invention showing the internal structures of the various components of the plenum.

FIGS. 5A and 5B, as well as 6A and 6B, show the fully assemble gas buffer plenum of the present invention. FIG. 5A is a perspective view of a gas buffer plenum 12 shown fully assembled with each of the internal components visible as they would be positioned and oriented for operation of the gas buffer plenum. FIG. 5A is an assembled perspective view of the barrel gas buffer plenum 12 of the present invention showing the internal positioning of the various components of the plenum. In this view, the plenum tube 22 is shown to surround the various chamber walls as described above and to be closed off on the target side with the target side end cap 32 positioning exit port 24 with projectile aperture 42. On the opposite side of gas buffer plenum 12 is the barrel side end cap 34 with barrel the attachment fixture 30 providing an inlet opening 38, typically internally threaded to receive the external threading of the barrel to which the gas buffer plenum is attached. The gas return port 40 is also shown in dashed outline form in FIG. 5A, whereby collected high pressure gas is ducted back to the firearm by way of the connecting gas tube (not shown).

FIG. 5B is a cross-sectional view taken through the center line of gas buffer plenum 12 of the present invention. In this view, each of the components is shown in cross-section starting with the target side end cap 32 which fits securely into plenum tube 22 and closes off the internal volume taken up generally by the chamber walls 36*a*-36*c*. The opposite end of the plenum tube 22 is closed off with the barrel side end cap 34, which likewise fits tightly into the plenum tube 22 to fully enclose the gas buffer plenum, with the exception of the projectile path (dotted line arrow) and the return gas path (solid line arrow).

Because the gas behind the projectile is rapidly expanding, the passage of the projectile from the end of the firearm barrel allows the expanding gas to be directed outward from behind the projectile rather than simply pushing the projectile forward, as it does within the barrel. This outward expansion of the gas is captured and directed by each of the chamber walls 36A-36C. The greater the number of chamber walls, the more of the high-pressure expanding gas is collected and eventually ducted back to the weapon receiver through a gas return port 40 by way of the gas tube (not shown). Each of the components of the gas buffer plenum 12 shown in FIGS. 5A & 5B, may be assembled through a variety of secure fittings and seam closures as described above. Again, other than the intended projectile ports and gas return port, all seams for the gas buffer plenum 12 should be closed so as to fully contain and appropriately direct the high-pressure gas that the plenum experiences. Again, various methods of assembling and securing the components together with tight seams are anticipated. Those skilled in the art will recognize that the basic structures of the gas buffer plenum shown in FIG. 5B (for example) may be constructed from separate components, or may be machined from a single solid material component, or as few as two attached milled and machined components. The various components described in the preferred embodiment herein need not be configured separately, but do describe as separate components, the various essential features of the fully assembled or fully constructed gas buffer plenum 12.

Figure 6B:
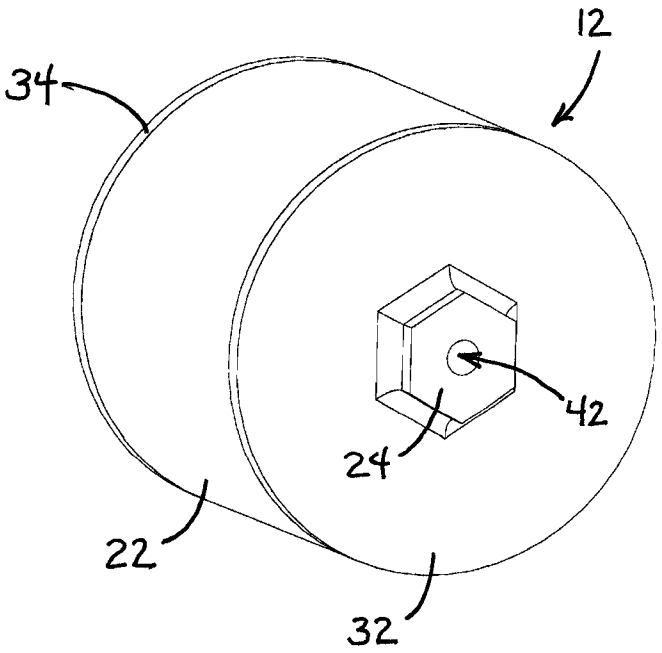
FIGS. 6A & 6B are perspective views of the end of barrel gas buffer plenum of the present invention showing the barrel side (FIG. 6A) and the target side (FIG. 6B).
Figure 6A:
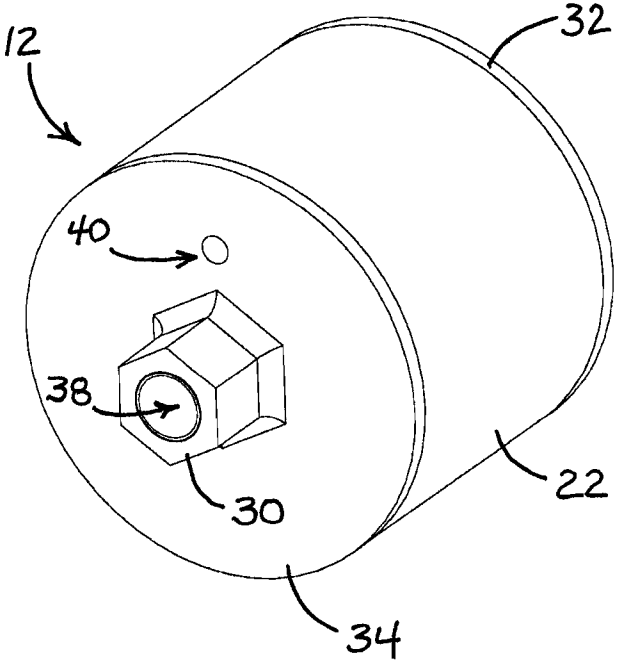

FIGS. 6A & 6B are perspective views of the end of the barrel gas buffer plenum 12 of the present invention, showing the barrel side (FIG. 6A) and the target side (FIG. 6B). On the barrel side, shown in FIG. 6A, the plenum tube 22 is shown to be closed off with the target side end cap 32 and the barrel side end cap 34. Positioned on the barrel side end cap 34 is a barrel attachment fitting 30 with a barrel connection port 38. Also shown on the barrel side end cap 34 is a gas return port 40. FIG. 6B shows the target side of the gas buffer plenum 12, providing the plenum tube 22 closed off with the target side end cap 34 and the barrel side end cap 32. Positioned on the barrel side end cap 32 is a hexagonal exit port fitting 24 with the projectile aperture 42 shown centered in the construction.

Figure 7B:
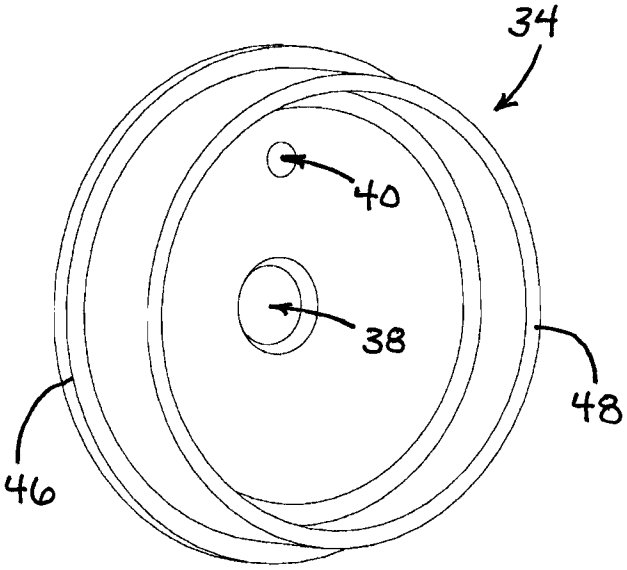
FIGS. 7A & 7B are perspective views of the barrel side end cap of the end of barrel gas buffer plenum of the present invention showing the external face (FIG. 7A) and the internal face (FIG. 7B)
Figure 7A:
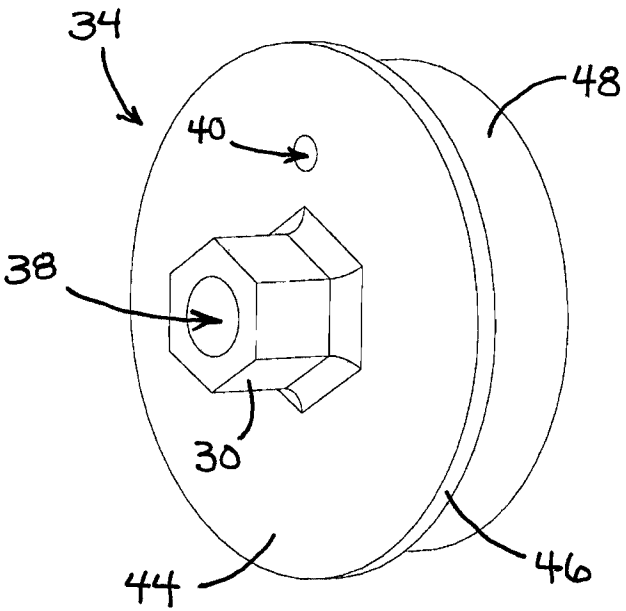

FIGS. 7A and 7B are perspective views of the barrel side end cap of the end of the barrel gas buffer plenum 12 of the present invention, showing the external face (FIG. 7A) and the internal face (FIG. 7B) of the component. The barrel side end cap, in the preferred embodiment, is constructed from a generally cylindrical wall 48 sized to fit within a machined recess in the plenum tube 22, as described above. The cylindrical wall 48 is closed by way of a circular wall 46, which establishes barrel side face 44. Centrally positioned within the barrel side face 44 is a barrel attachment fitting 30 with a barrel attachment port 38. Also positioned within the barrel side face 44 is a gas return port 40 to which a gas tube (not shown) is attached. FIG. 7B shows the internal features of the barrel side end cap 34 with the cylindrical wall 48 closed by a wall 46 with the central port 38 and gas return port 40 shown positioned therein.

Figure 8A:
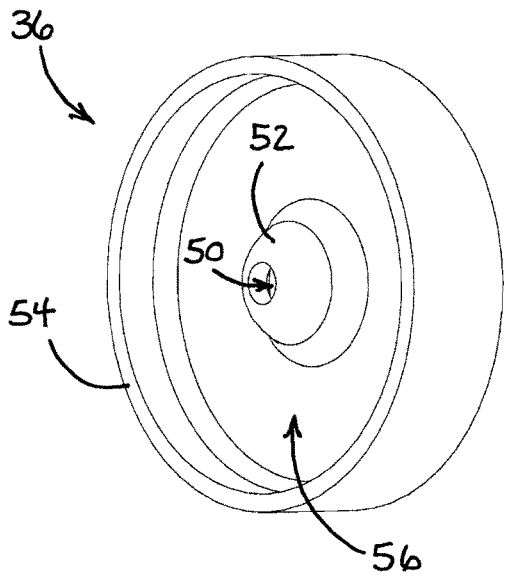
FIGS. 8A & 8B are perspective views of a typical (one of three in the preferred embodiment) chamber wall of the end of barrel gas buffer plenum of the present invention showing the barrel side face (FIG. 8A) and the target side face (FIG. 8B)
Figure 8B:
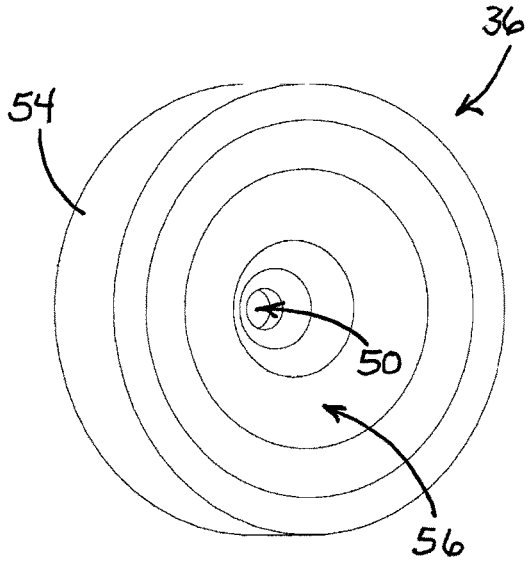

FIGS. 8A and 8B are perspective views of a typical (one of three in the preferred embodiment) chamber wall of the end of the gas barrel buffer plenum of the present invention showing the barrel side face (FIG. 8A) and the target side face (FIG. 8B). The construction of the chamber wall 36 includes a cylindrical wall 54 with an internal circular wall 56. Centrally positioned on the circular wall 56 is a gas extraction dome 52, which is a portion of the interior chamber wall that extends towards the barrel and generally serves to spread the expanding gas out to all sides after the passage of the projectile through the projectile port 50. In this manner, the expanding gas directed to the side, may return by way of the gas return port (not shown), having been collected by the one or more chamber walls as the projectile passes through the gas buffer plenum and the expanding gas is directed outward by the shaped configuration of each of the chamber walls.

Figure 9A:
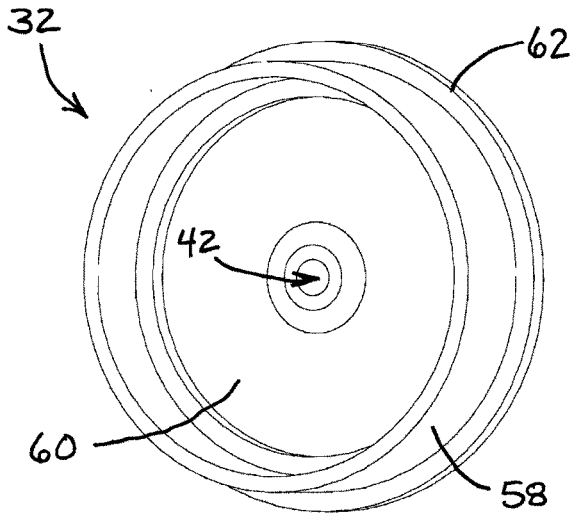
FIGS. 9A & 9B are perspective views of the target side end cap of the end of barrel gas buffer plenum of the present invention showing the internal face (FIG. 9A) and the external face (FIG. 9B)
Figure 9B:
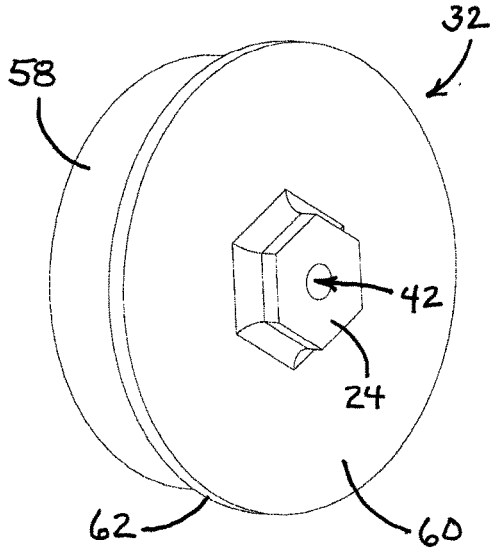

FIGS. 9A and 9B are perspective views of the target side end cap of the end of barrel gas buffer plenum of the present invention showing the internal face (FIG. 9A) and the external face (FIG. 9B). Like the barrel side end cap 34, the target side end cap 32 is constructed of a cylindrical wall 58 closed off with a circular wall 60, through which a projectile port 42 is centrally configured. A circular edge 62 provides the seat against which the plenum tube 22 fits in order to fully close off the gas buffer plenum. FIG. 9A shows the target side view of the target side end cap, again disclosing a cylindrical wall 58 which fits within the plenum tube 22, as well as an edge 62 which meets the mating edge of the plenum tube 22. The target side face 60 is shown to centrally contain an exit port 24 with a projectile exit aperture 42 centrally positioned therein.

Reference is next made to FIGS. 10A-10F for a detailed description of an optional barrel mounted gas block valve to complete certain embodiments of the system of the present invention. Whereas the end of the barrel gas buffer plenum 12 that is the primary focus of the present invention may be utilized in conjunction with firearms that do not have existing barrel gas port return structures, it is also possible to retrofit an existing automatic firearm that does incorporate a barrel gas port so that it may utilize the buffer plenum of the present invention in a replacement or an alternate manner. The gas block valve 14 shown initially in FIGS. 2A and 2B, may be positioned on the barrel of the firearm in place of whatever existing return gas port connection may already be in place. The structure of the gas block valve 14 when it is used in an alternate preferred embodiment of the present invention is as shown in FIGS. 10A-10F.

Figure 10B:
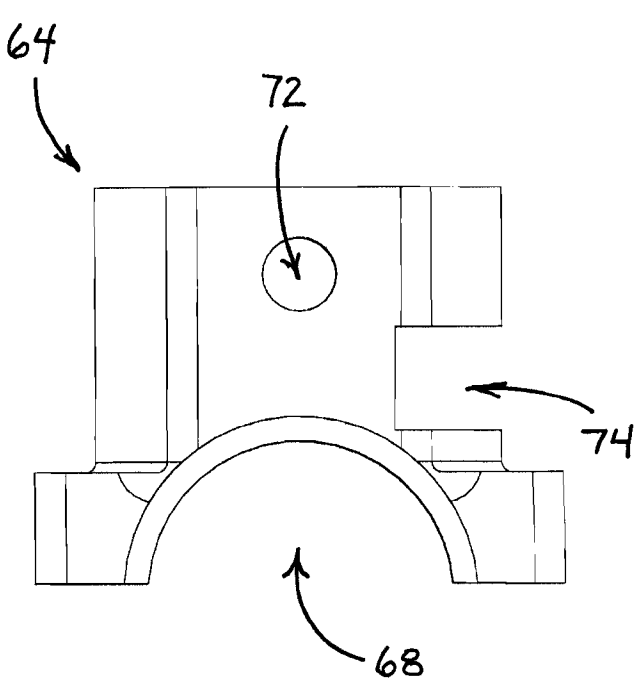
FIG. 10B is a detailed side view of the top component of the barrel mounted gas block valve of the system of the present invention.
Figure 10A:
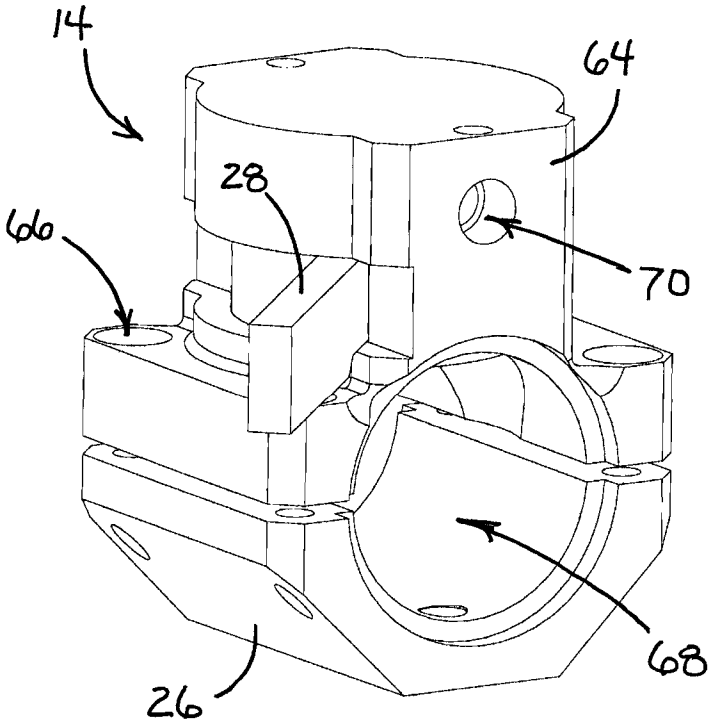
FIG. 10A is a detailed perspective view of the barrel mounted gas block valve of the system of the present invention.

FIG. 10A is a detailed perspective view of the barrel mounted gas block valve of the second preferred embodiment of the system of the present invention. In this view, the gas block valve 14 is configured as it would appear mounted to the barrel of the firearm. The barrel itself is removed in this view for clarity, but would be positioned through barrel port 68 configured by the connection of the two halves of the gas block valve 14. A top half 64 is positioned on the top of the barrel, while a bottom half 26 is aligned and connected to the top half through a number of attachment bolts, screws, or the like. The four attachment bolts or screws may be positioned in apertures 66 on the top half 64 of the valve and may be received into threaded apertures 94 which are positioned in an aligned manner on the bottom half 26 of the gas block valve.

The object of gas block valve 14 is to allow the user to direct the expanding gases within the barrel back to the firearm receiver, either in the conventional manner by ducting them away from a position on the barrel where a gas port has been drilled, or closing the gas port on the barrel and conducting the expanding gas back from the end of the barrel gas buffer plenum of the present invention. In FIG. 10A, a forward port 70 in the top half 64 of the gas block valve 14 receives the expanding gas from the end of the barrel gas buffer plenum of the present invention. A valve lever 28 allows the user to switch between the gas port drilled in the barrel and the gas port 70 receiving the expanding gas from the end of the barrel gas buffer plenum. The valve lever 28 moves within a slot 74 positioned on the side of a top half 64 of the gas block valve 14. A gas port 72 directs the expanding gas from either of the two selected sources back to the receiver of the firearm.

Figure 10D:
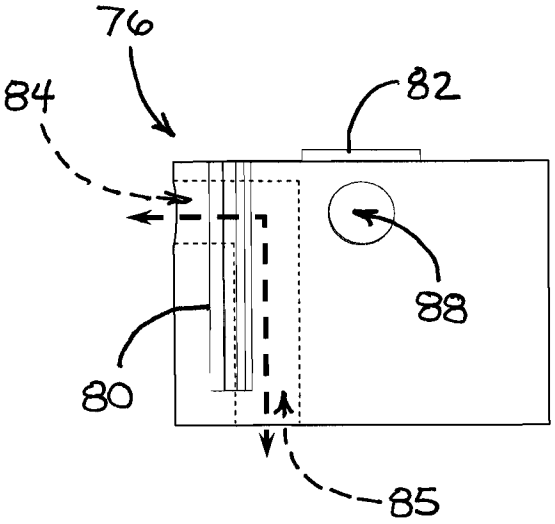
FIGS. 10C & 10D are detailed side views of the rotating valve core of the barrel mounted gas block valve of the system of the present invention; the view in FIG. 10D rotated 90° from the view in FIG. 10C.
Figure 10C:
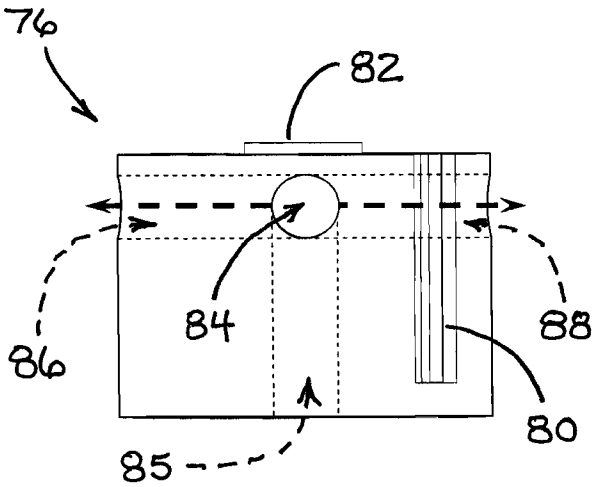

FIGS. 10C and 10D show in detail the structure of the internal core of the gas block valve 14, comprising a rotating cylinder with appropriately constructed conduits to alternately direct expanding gas straight through the valve from the gas buffer plenum, or up from the gas port in the barrel and out the back of the gas block valve. A rotating valve core 76 pivots on an axis 82 and is moved by the use of the valve lever 28, which is positioned within a captive slot 80 on the side of the rotating core. A port 88 connects straight through the core to the port 86 and connects the gas input from the gas buffer plenum to the gas output on the valve when the gas port in the barrel is cut off. Rotating the valve core 76 positions the gas port 85 in the core with the gas port drilled in the barrel (see FIG. 11A) and conducts the expanding gas therefrom out through gas port 84 in valve core 76 at a right angle to the gas port drilled in the barrel. Dashed line arrows in FIGS. 10C and 10D represent the two alternate flows of expanding gas through valve core 76.

Figure 10E:
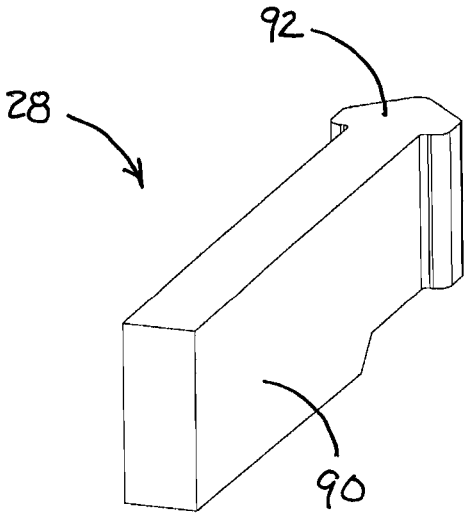
FIG. 10E is a detailed perspective view of the valve lever of the barrel mounted gas block valve of the system of the present invention.
Figure 10F:
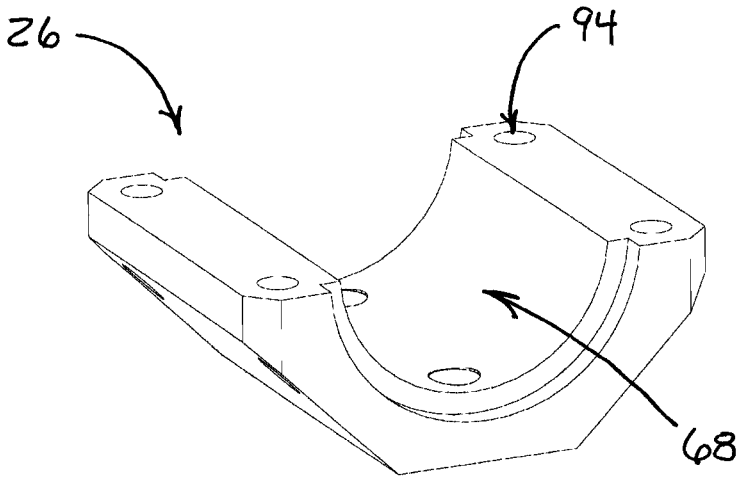
FIG. 10F is a detailed perspective view of the bottom component of the barrel mounted gas block valve of the system of the present invention.

FIG. 10E is a detailed perspective view of valve lever 28 comprising a captive slot tab 92 structured to engage and be held captive by slot 80 in the rotating core, as well as a lever handle 90. FIG. 10F is a detailed perspective view of the bottom half 26 of the gas block valve 14 which attaches to the top half 64 in the manner described above.

Figure 11A:
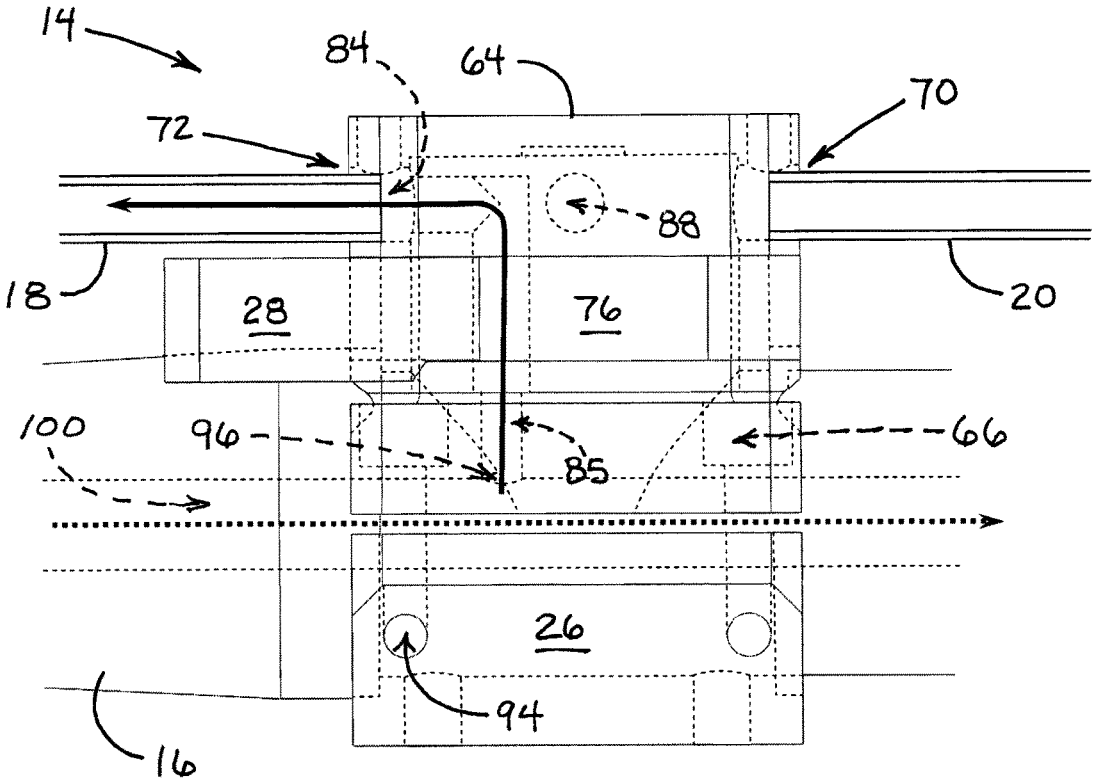
FIGS. 11A & 11B are detailed side elevational views of the barrel mounted gas block valve of the system of the present invention, FIG. 11A showing the valve in a condition for directing gas up through the prior art barrel port back to the bolt action, and FIG. 11B showing the valve in a condition for directing gas from the end of the barrel plenum of the present invention back to the bolt action.
Figure 11B:
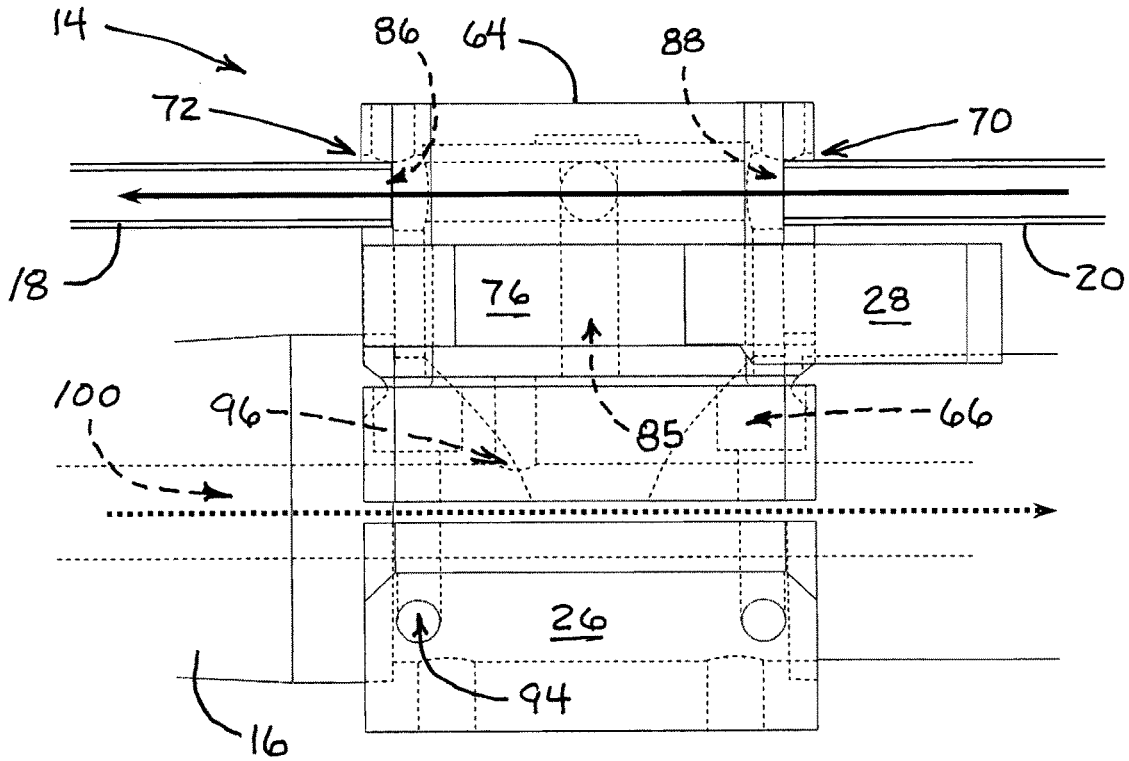
Figure 12:
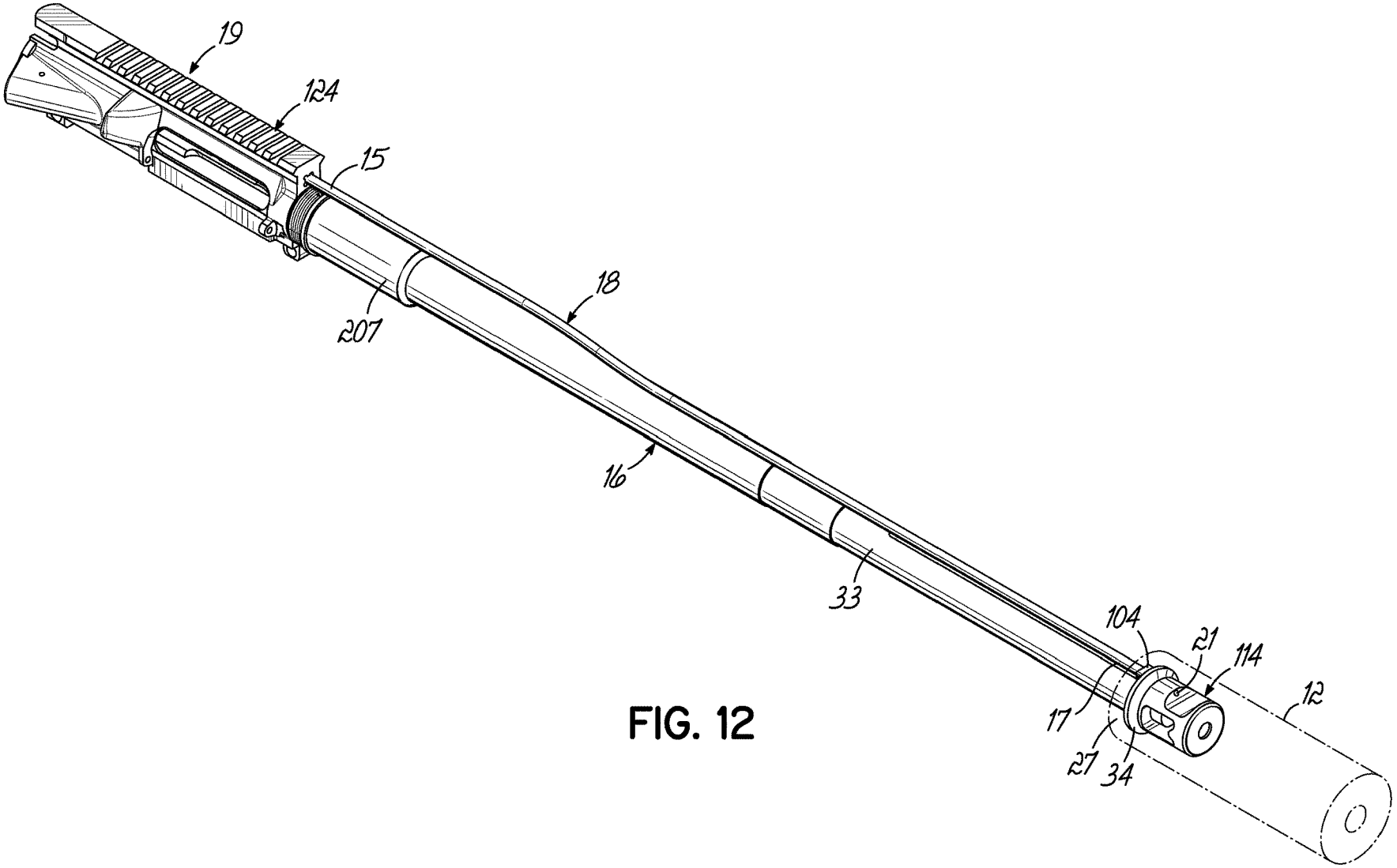
FIG. 12 is perspective view showing a system according to an embodiment of the invention in which the gas tube is secured to a muzzle device.

FIGS. 11A and 11B show in greater detail the manner in which the various gas flow conduits are alternately established depending upon the rotation of the valve lever 28 and its corresponding rotation of the valve core 76. FIG. 11A shows a manner of utilizing the gas port drilled or pre-drilled into the barrel of the firearm comprising a barrel gas port 96. The port 96 represents a drilled passage from the external surface of the barrel to the rifled bore 100 of the barrel 16. In the view of FIG. 11A, a port 70 connects by way of a gas tube 20 forward to the gas buffer plenum of the present invention. A port 72 connects the gas block valve 14 by way of the gas tube 18 to the receiver mechanism for the firearm.

FIG. 11B shows the result of rotating the valve core 76 by pushing the valve lever 28 forward, thereby cutting off the barrel port 96 and opening the straight through conduit of the valve core 76, comprising connecting a port 88 with another port 70 and port 86 with port 72. This straight through configuration shown in FIG. 11B represents the preferred use of the system of the present invention, cutting off any pre-existing barrel gas ports and utilizing the end of the barrel gas buffer plenum. In FIGS. 11A and 11B, gas flow is shown with solid line arrows, and the path of the projectile through the barrel is shown with dotted line arrows.

In another aspect of the present invention, a gas tube support system 102 contains an annular or bored housing 104, for receipt of the gas tube 18 therein, thereby securing the gas tube 18 during operation of the firearm. In accordance with the present invention, and as shown in FIGS. 12-24, a radially imperforate barrel 16 fluidly communicates with the gas tube 18 at a target or muzzle end of the barrel 16 and a target end 17 of the gas tube 18. Barrel 16 contains a first or chamber end 25, and a second or muzzle end 27. The term "radially imperforate" is meant to convey that the barrel 16 has no radial bores or passages extending from an inner annular wall 31 of the barrel 16 to an outer circumferential wall 33 of the barrel 16. Unlike state-of-the-art gas blocks, for example, in one non-limiting exemplary embodiment, the present support system 102 supports a barrel 16 that has a barrel bore 29 defining openings at both the first or receiver/chamber end 25 and the second or muzzle end 27, but at no points therebetween.

Figure 13:
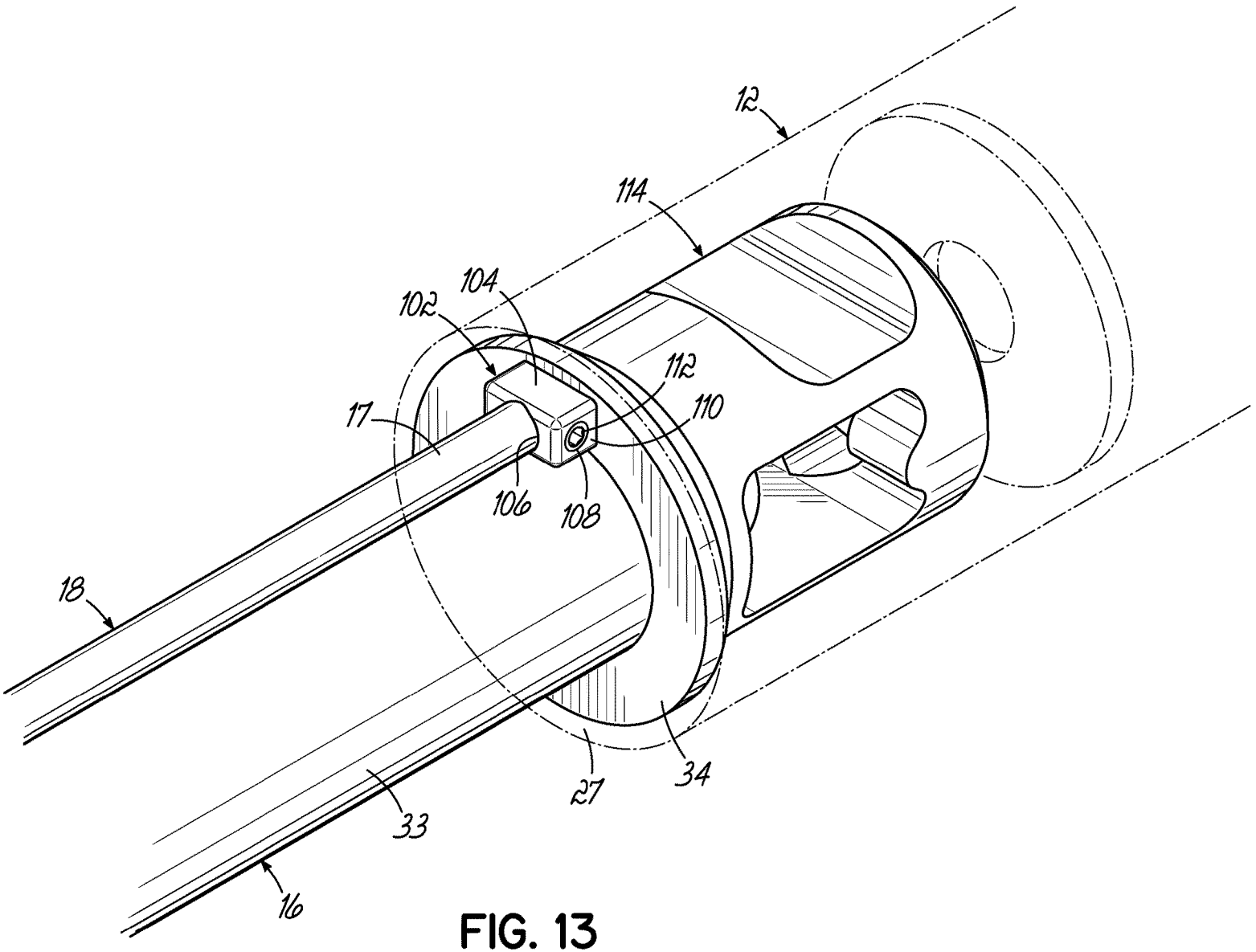
FIG. 13 is an enlarged perspective view of the muzzle device attachment.

In a first exemplary embodiment shown in FIGS. 12-16, the annular or bored housing 104 is fixed to the muzzle device or plenum 12. More specifically, as shown in FIG. 13, the annular or bored housing 104 is secured to the barrel-side end cap 34, at an upper portion thereof. The housing 104 may be monolithically integrated on the barrel side of the end cap 34 during the manufacturing process, or, it may simply be fastened to the end cap 34 by welding, fasteners, or some other known method. A first annulus 103 formed through the annular or bored housing 104 defines an inner annular wall 106 for receipt of a portion of the gas tube 18. A first support bore 108 may be drilled or otherwise formed into a side wall 110 of the annular or bored housing 104. A first fastener 112, such as a screw, roll pin, or assembly pin, is threadedly or otherwise received within the bore 108 whereby, when tightened, the fastener 112 secures the gas tube 18 within the annular or bored housing 104 to the muzzle device or plenum 12. Although not shown, if desired, additional fastener bores may be drilled or otherwise formed to accommodate any number of additional respective fasteners.

Figure 14:
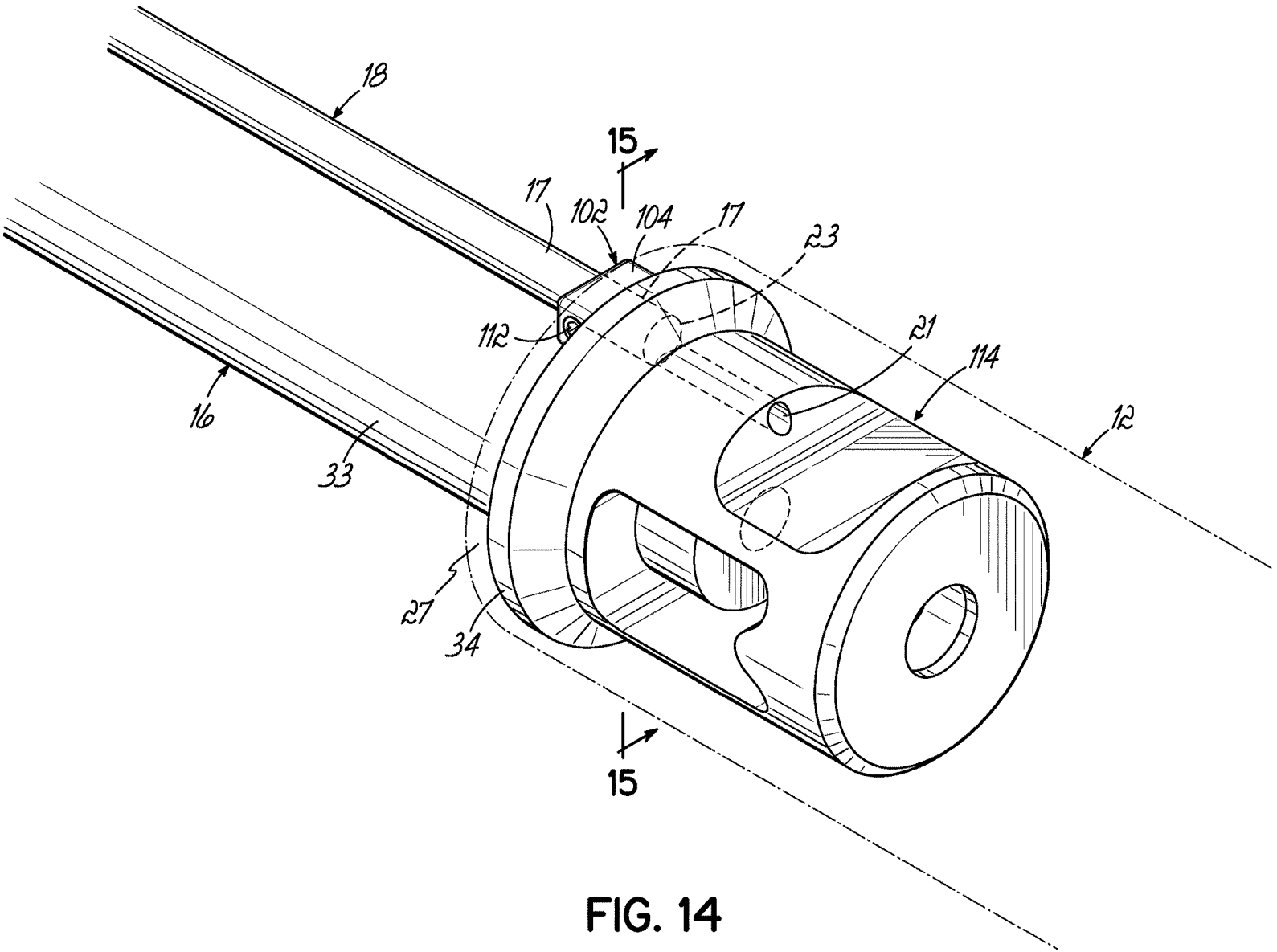
FIG. 14 is another perspective view thereof.
Figure 15:
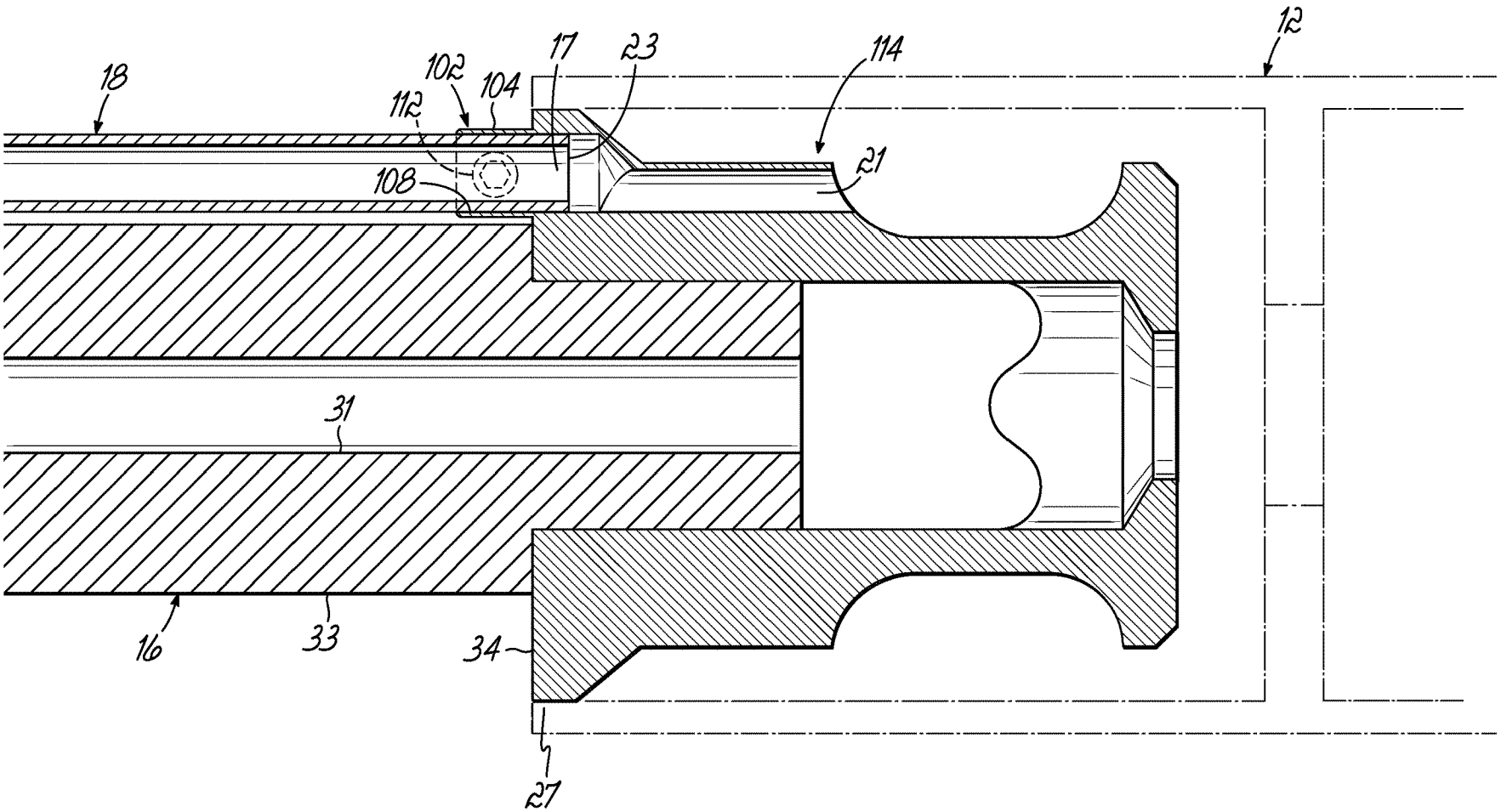
FIG. 15 is a side sectional view taken substantially along line 15-15 of FIG. 14.
Figure 16:
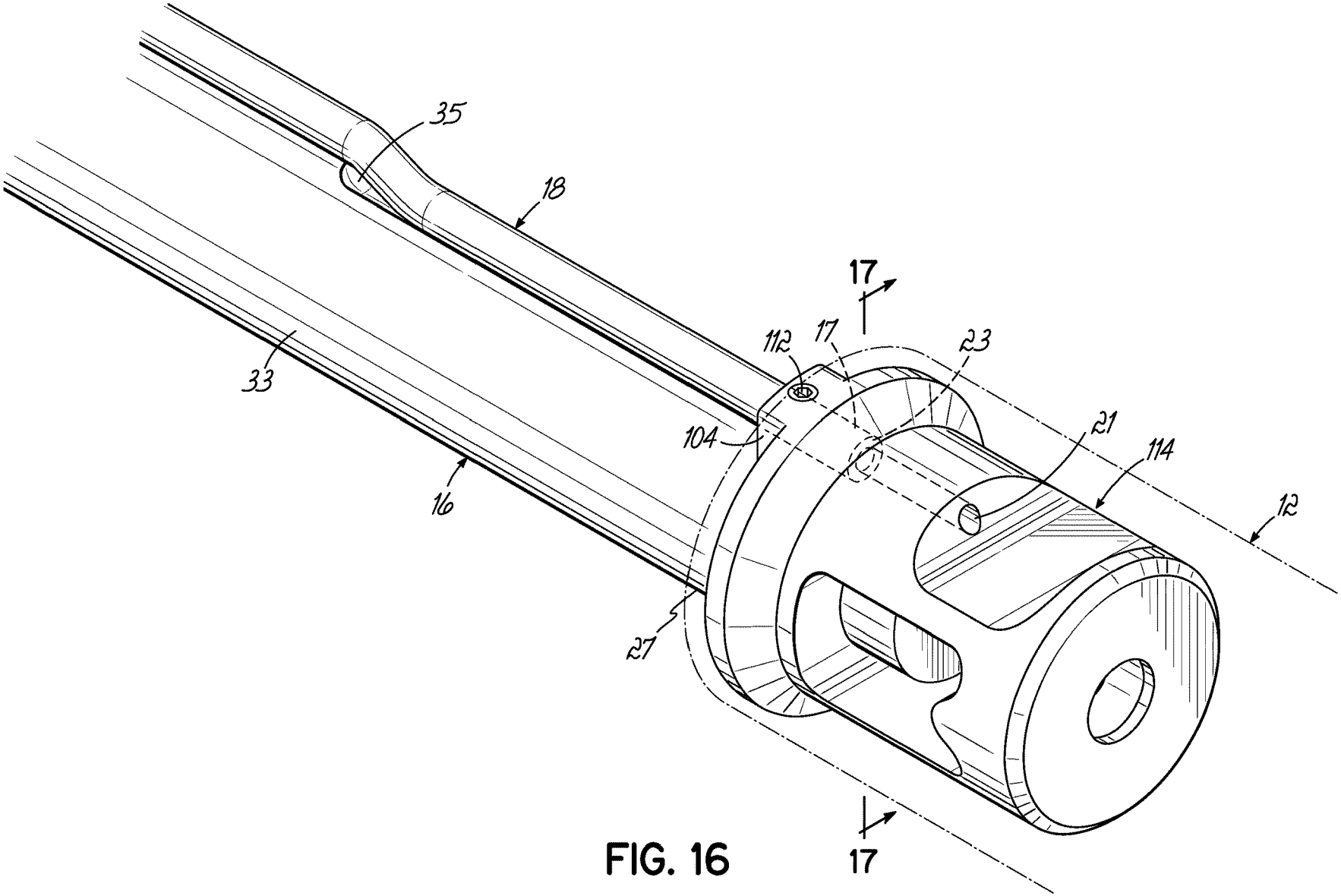
FIG. 16 is an enlarged perspective view of another embodiment of the invention.

As further shown in FIGS. 14 and 16, the gas tube 18 fluidly communicates with and extends from within the muzzle device 12 through the barrel end cap 34, then through the annular or bored housing 104, to thereby operably extend back to the receiver 19 and bolt carrier group 148. Stated another way, the gas tube 18 has a rearward or first end 15 and a second or target end 17 in operable communication with a muzzle passageway 21 that extends within the muzzle device or plenum 12.

Figure 17:
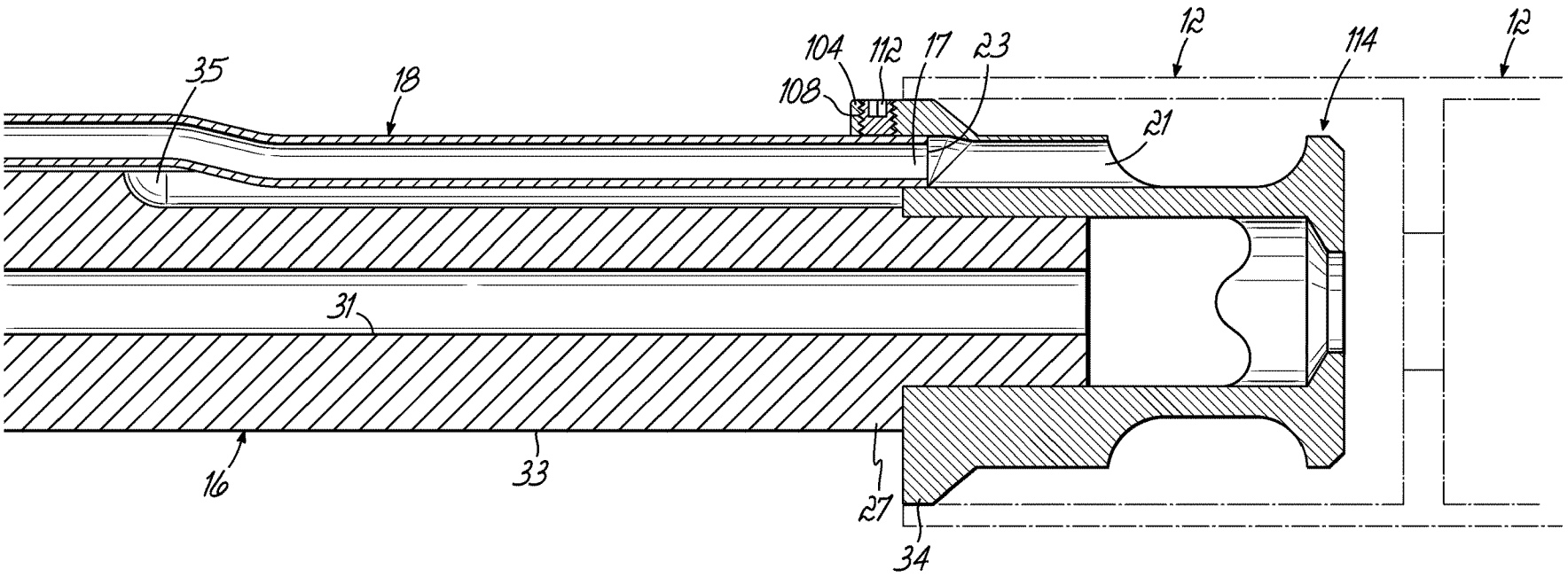
FIG. 17 is a side sectional view taken substantially along line 17-17 of FIG. 16.

A related embodiment is illustrated in FIGS. 16 and 17. Comparative to FIG. 16, FIG. 17 illustrates the first support bore 108 as being formed in the top of the annular or bored housing 104. The first fastener 112 thereby impinges upon the gas tube 18 to thereby secure it within the housing 104. Yet further, the annular or bored housing 104 is shown as integrally formed with the muzzle 114. In this embodiment, the connection 23 of the gas tube 18 and the passageway 21, within the plenum 12, is at a radial position closer to the bore axis of the barrel 16. Such a connection may be needed when the muzzle device or plenum 12 extend radially outwardly from the barrel 16. To accommodate this, a flute 35 may be formed longitudinally on the outer surface of the barrel 16 to allow at least a portion of the gas tube 18 to be positioned closer to the bore axis. Although firearm barrels may be fluted for a variety of reasons or in a variety of styles, this flute 35 performs the new (or additional) function of accommodating a radially closer position of the gas tube 18, relative to the muzzle 114 and barrel 16, to thereby more directly establish fluid communication between the barrel 16 and the gas tube 18.

Figure 18:
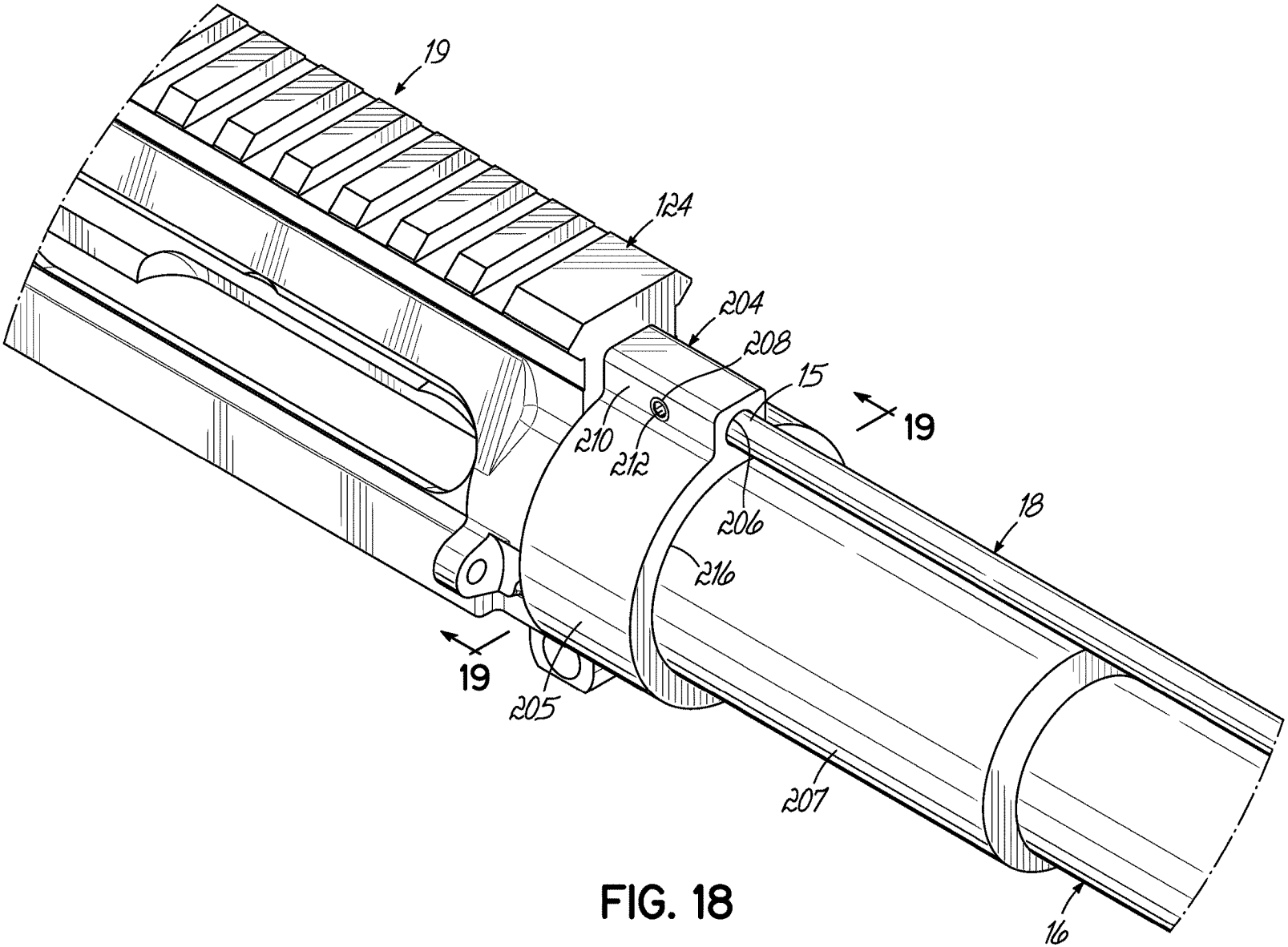
FIG. 18 is an enlarged perspective view of another embodiment of the invention.
Figure 19:
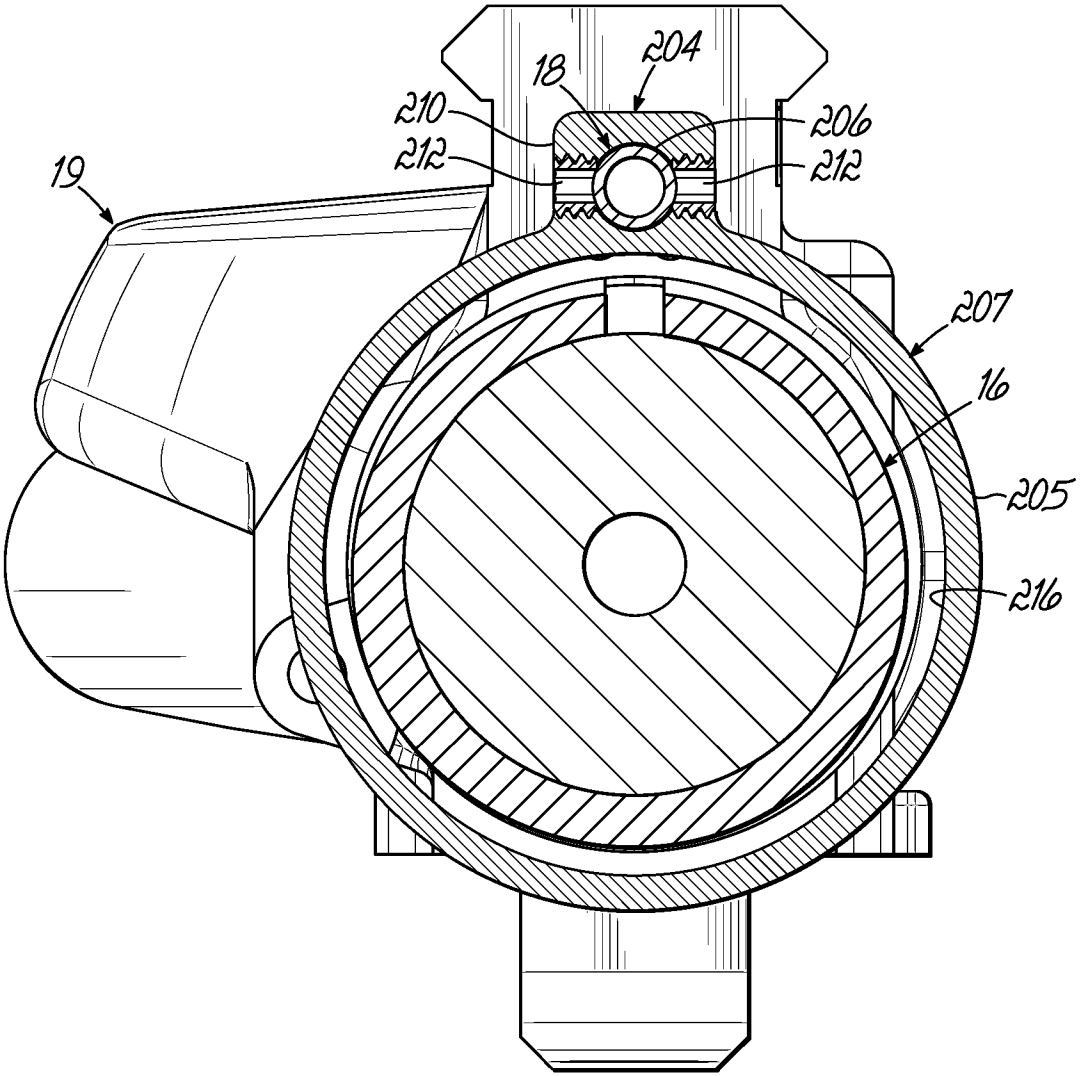
FIG. 19 is a transverse sectional view taken substantially along line 19-19 of FIG. 18.

In yet another embodiment shown in FIGS. 18 and 19, the annular or bored housing 204 may be positioned adjacent a rearward portion of the barrel 16 proximate to the receiver or bolt carrier group 148 of the firearm. As shown in FIG. 18, the first annular wall 206 is again formed within an upper portion of the annular housing 204, as part of the barrel nut 207. A second annulus 205 formed in a lower portion of the annular or bored housing 204 defines a second annular wall 216, whereby the annular wall 216 is fixed about the circumference of the barrel 16 or the barrel nut 207, proximate to the receiver or a rearward portion 19 of the firearm. At least one bore 208 may again be formed through the wall 210 and through the first annular wall 206 for receipt of the first fastener 212. As the fastener 212 is tightened against the gas tube 18, the gas tube fixed position during operation of the firearm is assured. As shown in FIG. 19, a second bore 218 may also be formed within a second wall 220 of the annular housing 204, in coaxial alignment with the first bore 208 and again through the first annular wall 206. A second fastener 222 is then threadedly or otherwise tightened within second bore 218 to further fix the gas tube 18 within the annular wall 206. As shown in FIG. 19, the first bore 208 and the second bore 218 are formed on opposing sides of the gas tube 18, at the three o'clock and nine o'clock positions, thereby providing a symmetric constraint to the gas tube 18.

Figure 20:
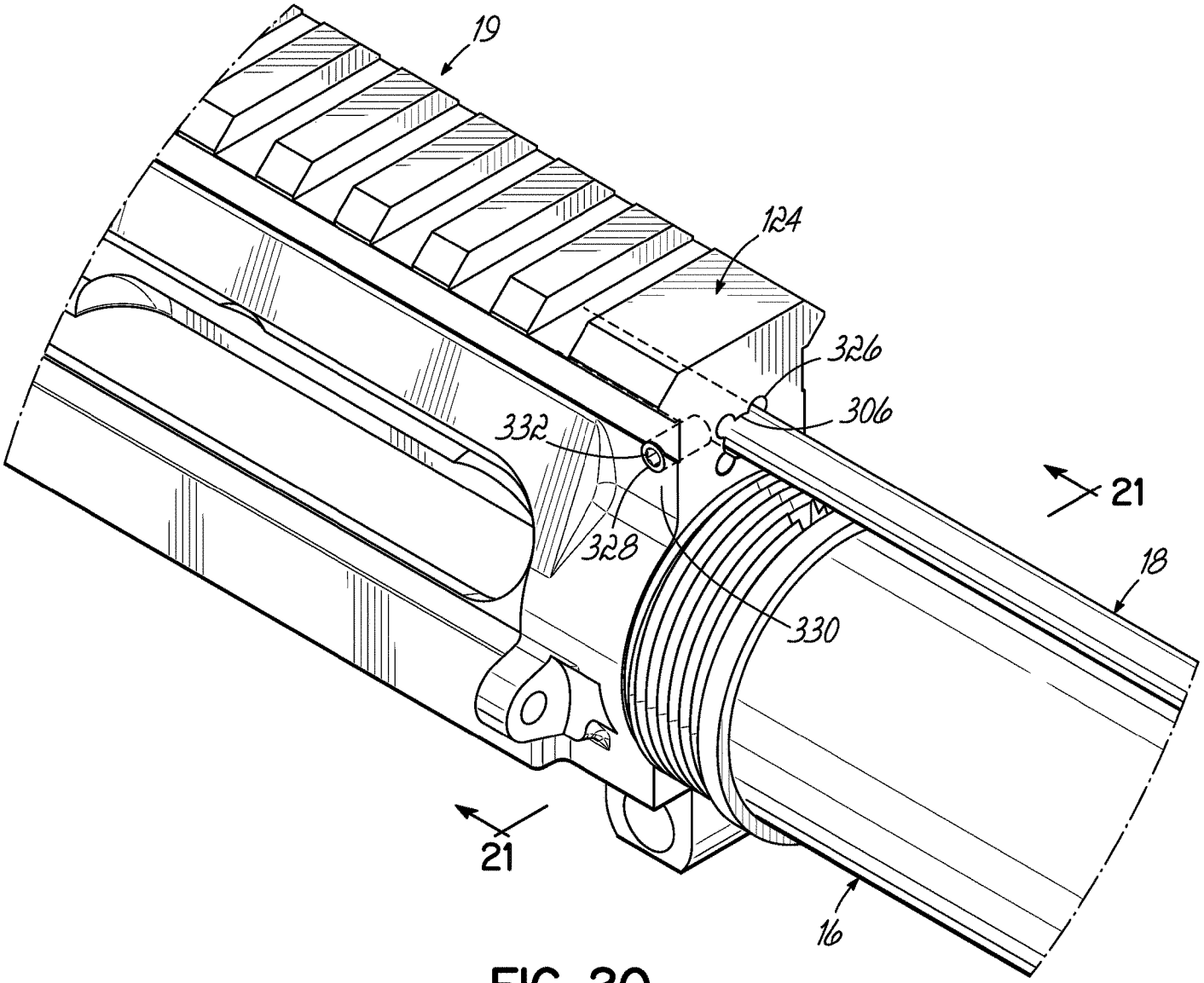
FIG. 20 is an enlarged perspective view of another embodiment of the invention.

As shown in FIG. 20, the gas tube 18 may alternatively be stabilized at the receiver or rearward portion 19 of the firearm by fixing the gas tube 18 to an alternative structural component of the firearm, within a thermal break structure 124 of the upper receiver, for example. A third bore 326 may be formed substantially coaxially with the thermal break structure 124, along a length thereof, whereby the gas tube 18 may be routed or channeled through the third bore 326 for stability during firearm operation. A fourth bore 328 may be drilled in a third wall 330 of the structure 124, and formed substantially orthogonal to a longitudinal axis A of the third bore 326. A third fastener 332 may be threadedly or otherwise received within the fourth bore 328, whereby when fastener 332 is advanced within bore 328, the fastener 332 snugs and/or tightens the gas tube 18 within the passage or bore 326 defined by the bored wall 306.

Figure 21:
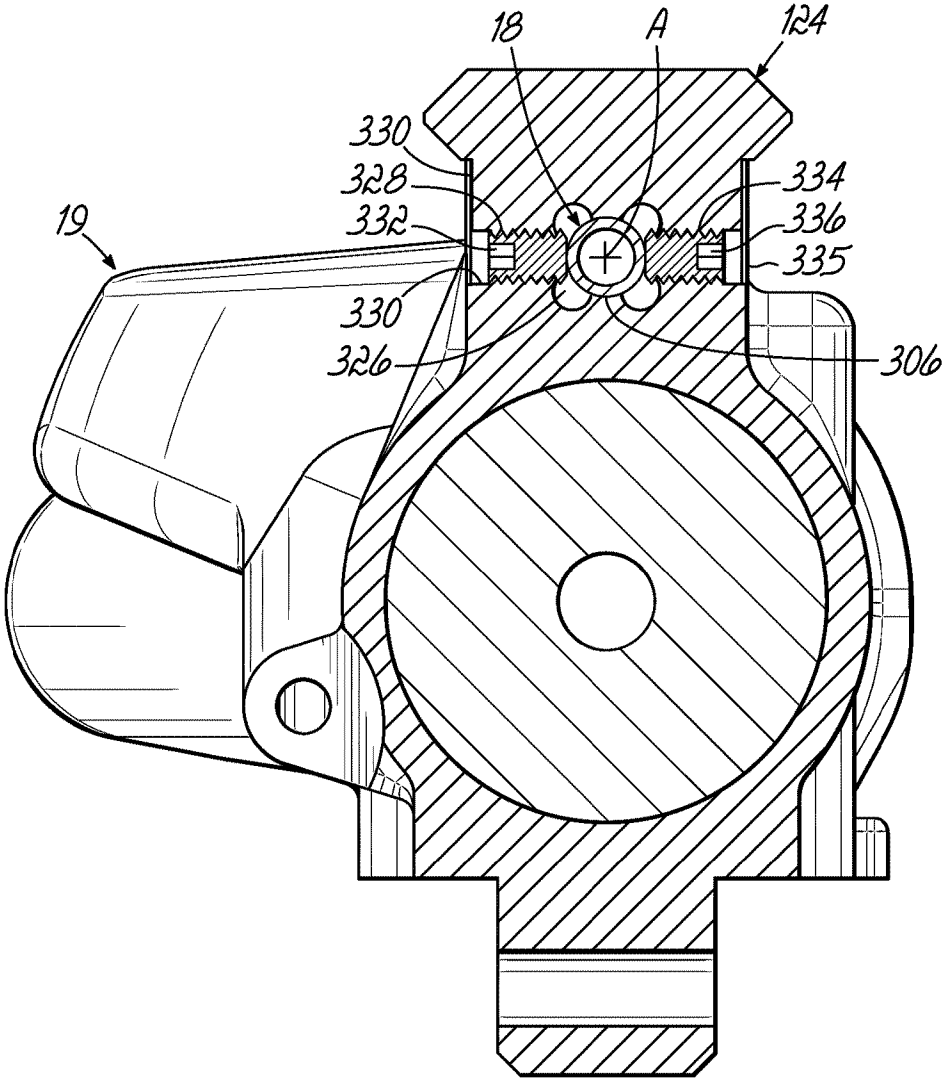
FIG. 21 is a transverse sectional view taken substantially along line 21-21 of FIG. 20.

As shown in FIG. 21, an opposing fifth bore 334 may also be formed within a fourth wall 335 of the structure 124, in coaxial alignment with the fourth bore 328, and again through an inner wall 306 defined by the third bore 326. A fourth fastener 336 is then threadedly or otherwise tightened within the fifth bore 334 to further fix the gas tube 18 within the third bore 326. As shown in FIG. 21, the fourth bore 328 and the fifth bore 334 may be formed on opposing sides of the gas tube 18, on opposite sides of the firearm, respectively, thereby providing a symmetric constraint to the gas tube 18.

Figure 22:
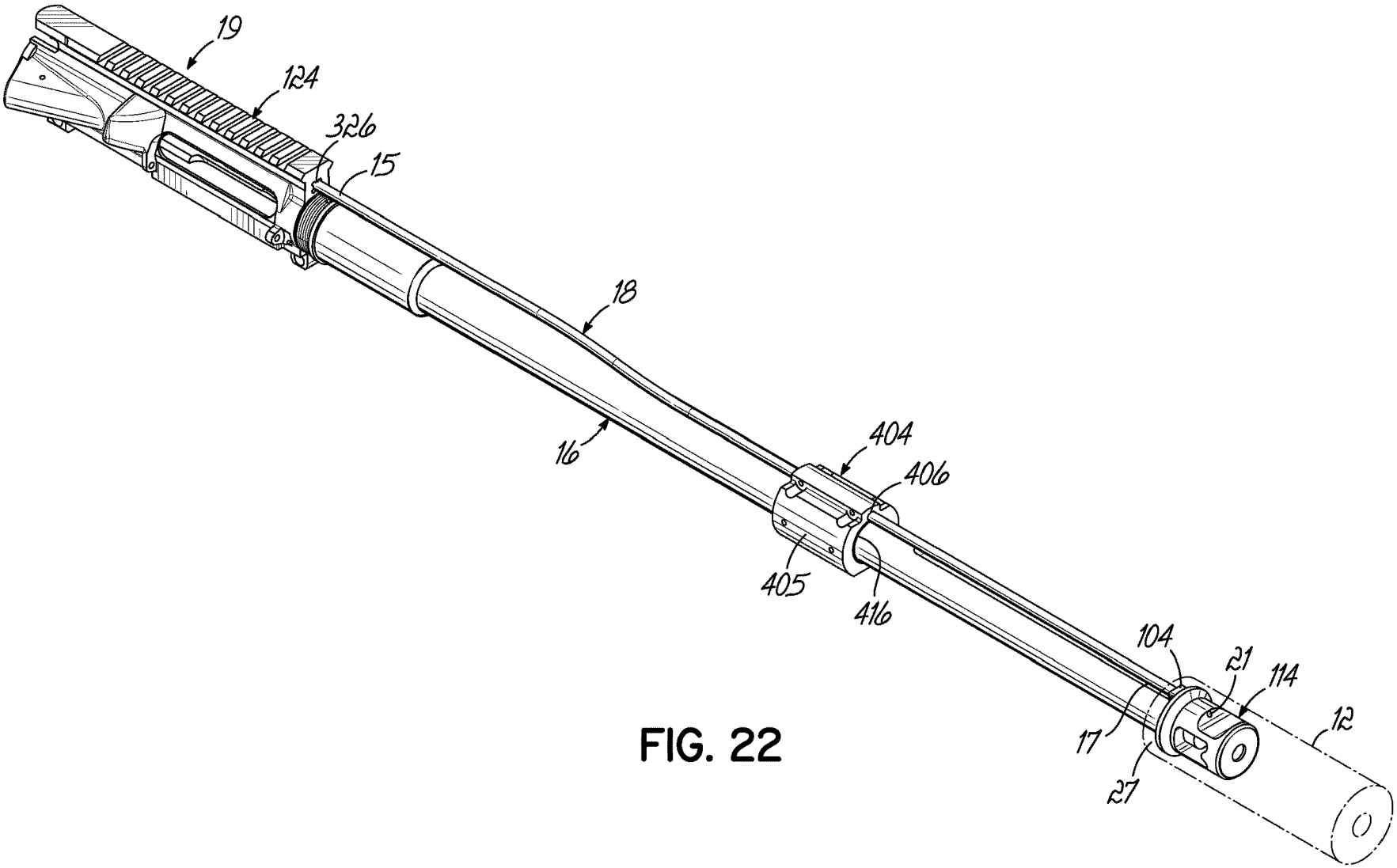
FIG. 22 is perspective view showing a system according to another embodiment of the invention in which the gas tube is supported on the barrel.
Figure 23:
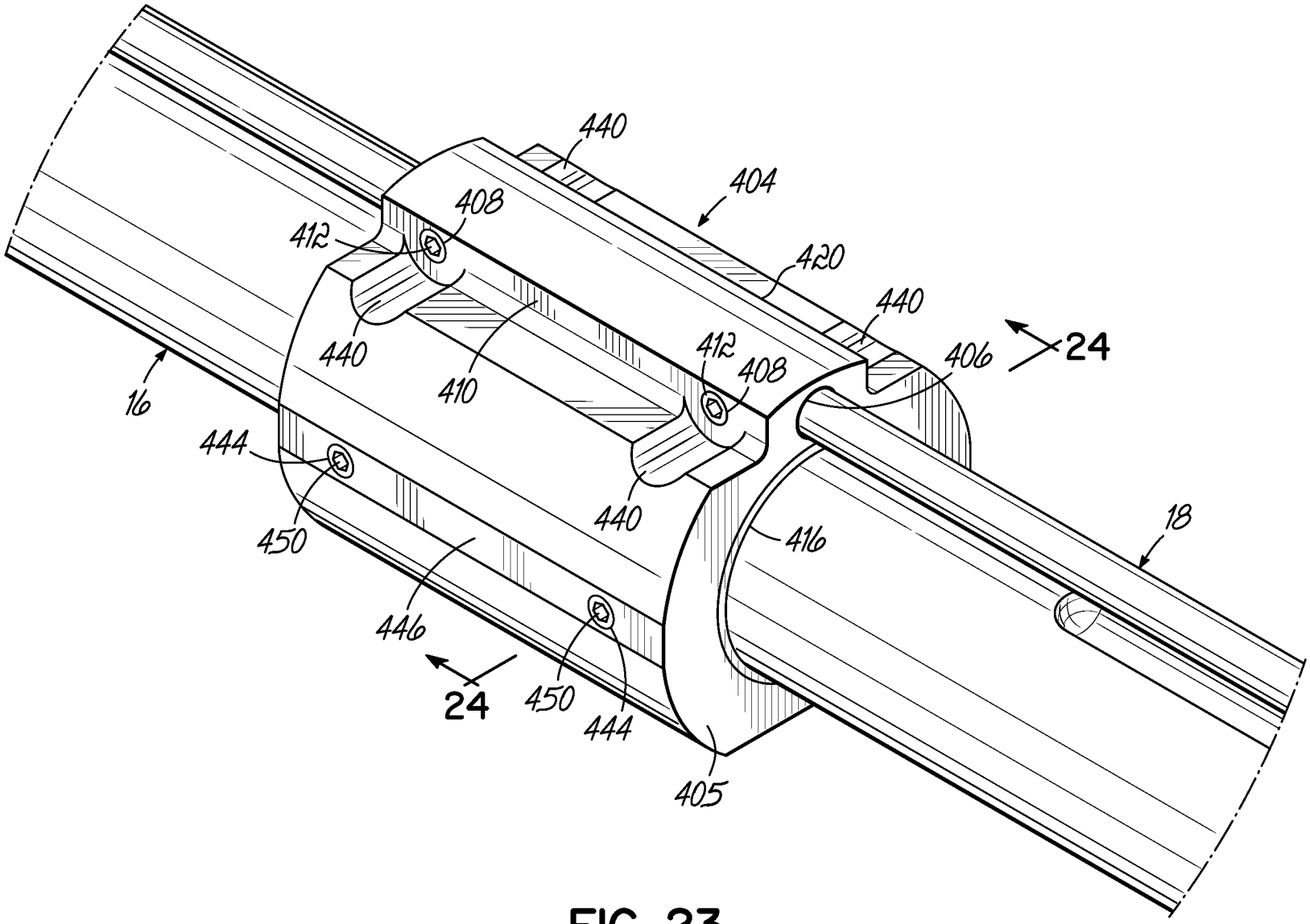
FIG. 23 is an enlarged perspective view thereof.
Figure 24:
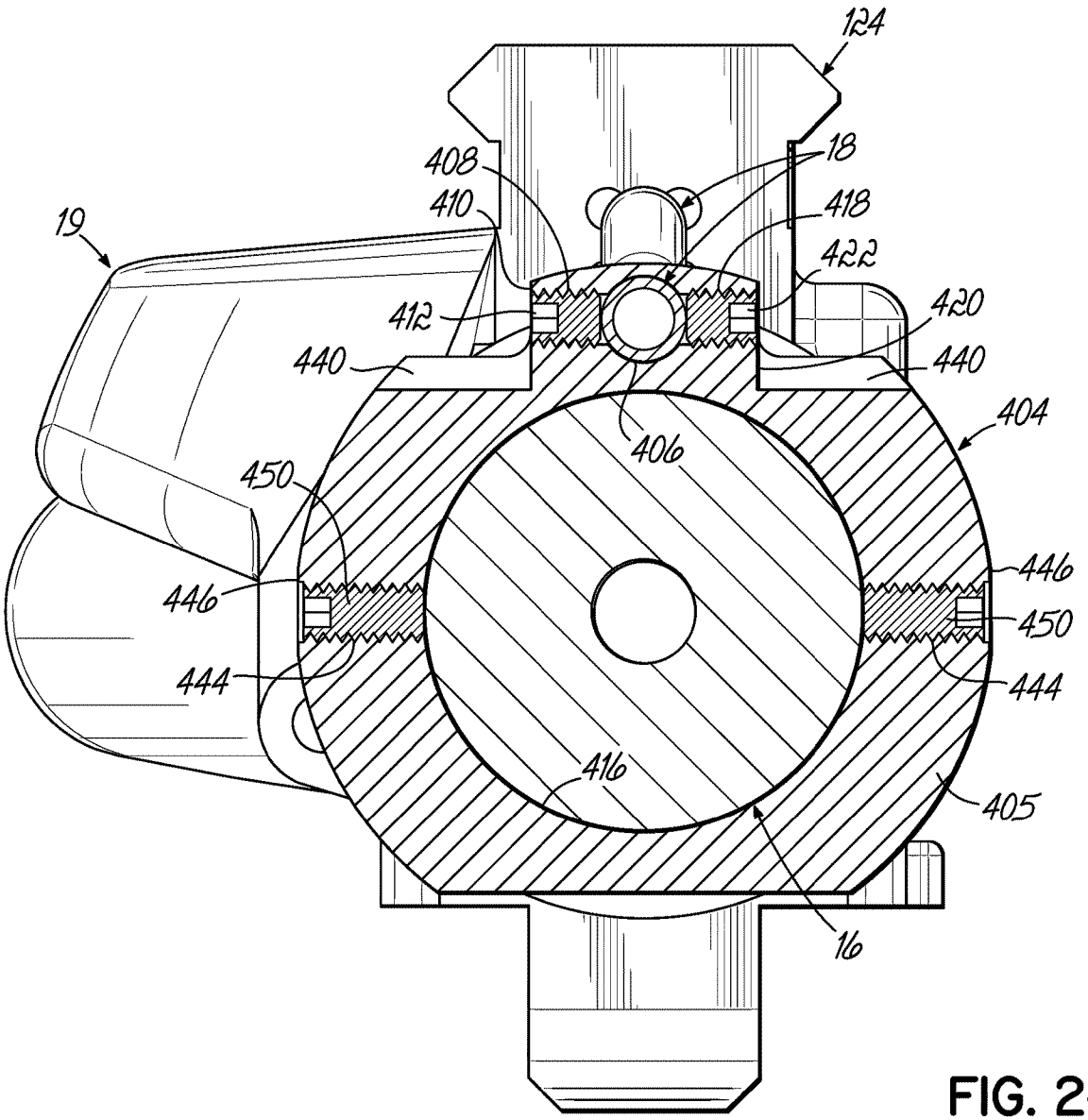
FIG. 24 is a transverse sectional view taken substantially along line 24-24 of FIG. 23.

In yet another embodiment shown in FIGS. 22-24, the gas tube 18 may be supported by an annular housing 404 attached to the barrel 16 medially between the rearward portion 19 of the firearm and the muzzle 114. As shown in FIGS. 22-24, a first annular wall 406 is again formed within an upper portion of an annular housing 404, for receipt of the gas tube 18. A second annulus 405 formed in a lower portion of the annular housing 404 defines a second annular wall 416, whereby the annular wall 416 is fixed about the circumference of a median portion of the barrel 16. At least one bore 408 may again be formed through the sidewall 410 and through the first annular wall 406 for receipt of a first fastener 412. Tightening of the fastener 412 against the gas tube 18 fixes the gas tube position during operation of the firearm. As shown in FIG. 24, a second bore 418 may also be formed within a second wall 420 of the annular housing 404, in coaxial alignment with the first bore 408 and again through the first annular wall 406. A second fastener 422 is then threadedly or otherwise tightened within an opposing second bore 418 to further fix or secure the gas tube 18 within the annular wall 406. As shown in FIG. 24, the first bore 408 and the second bore 418 may be formed on opposing sides of the gas tube 18, at the three o'clock and nine o'clock positions, thereby providing a symmetric constraint to the gas tube 18.

As further shown with regard to the embodiment of FIGS. 22-24, and referring to FIG. 23 specifically, a plurality of insets 440 may be formed to provide ready access to tighten or loosen a plurality of fasteners 412, 422 for example), about the gas tube 18. As also shown in FIG. 23 and FIG. 24, an exemplary plurality of insets 440 (four, as shown) may be formed to accommodate a plurality of a corresponding number of respective fasteners 412, 422 for securing the gas tube 18 within the annular housing 404. Yet further, a plurality of housing barrel bores 444 may be formed through one or more housing barrel side walls 446, wherein housing barrel bores 444 are preferably formed substantially orthogonal to a longitudinal axis of second annular wall 416. A plurality of barrel fasteners 450, corresponding in number to the plurality of housing barrel bores 444, may each be threadedly or otherwise received within a respective one of the housing barrel bores 444, to thereby snug the annular housing 404 about the barrel 16.

Embodiments of the present invention, which siphons gas pressure from a post-bore multi-chambered plenum, rather than through a radial gas port in the barrel, may provide one or more demonstrable benefits. First, because the gas pressure to cycle the action is collected forward of the muzzle, the projectile leaves the muzzle as if from a bolt-action rifle without any accuracy-reducing effect of the bolt unlocking or action beginning to cycle while the projectile is still in the barrel. Standard deviations of shots are greatly reduced from those associated with a typical AR-pattern rifle, as much as 30-40% in testing, similar to those of a bolt action rifle. Because no gas pressure is syphoned from the bore, muzzle velocity of the projectile may increase by as much as 6%.

Because the gas pressure is collected post-muzzle and the suppressor has to charge with gas (like a capacitor), there is a delay before the bolt starts to open and the cyclic rate is significantly slowed, including when used with a full-auto action. This can provide for manageable full auto fire (650-710 rounds per minute) with 10"-12" suppressed barrels. The system uses lower pressure and high volume to cycle, instead of the reverse found in a standard AR-pattern rifle. As a result, the bolt travel may be slower than traditional, which is less stressful on the weapon components and reduces the felt recoil to the shooter.

In standard operation, unburnt powder is forced through the port hole and back into the receiver, bolt and action under high pressure. This causes significant fowling of the action with a suppressor. This system can allow the powder to flash off and the gas to cool down in the suppressor expansion chamber(s), before it is directed into the action.

Because a traditional gas block leaks high pressure, hot gas, the handguard will heat up under rapid semi-auto fire, and especially with full-auto fire. This causes the handguard to heat up so that the user burns their hand or heats up their glove. Because there can be no porthole or gas block in this design, this may be eliminated.

The system may also reduce the measured decibels of a suppressed automatic rifle. This is due to the bolt remaining closed longer than a standard automatic rifle. The pressures drop significantly so the gas noise upon bolt opening is greatly reduced. The delay in cycling may cause the sound of mechanical movements to be delayed relative to the sound of the muzzle blast. Thus, the sounds are sequential, rather than simultaneous, reducing the overall sound signature (decibel rating) of the suppressed firearm.

While the present invention has been described in conjunction with a number of preferred embodiments, those skilled in the art will recognize that certain modifications to the described embodiments still fall within the spirit and scope of the invention. Accordingly, the scope of the present invention is not meant to be limited by the disclosure herein, but only as provided in the appended claims.

What is claimed is:

1. A gas-actuated firearm comprising:

a radially imperforate barrel having a barrel bore, a chamber end, and a muzzle end;

a plenum forward of the muzzle end and through which a projectile passes when fired, said plenum having a plenum tube and a plurality of baffles separate from said plenum tube and assembleable therein forming multiple chambers through which the projectile passes successively, each said baffle comprising a wall having a central opening through which the projectile passes, said baffle wall extending from said central opening to said plenum tube, said plenum having a pair of end caps separate from said plenum tube and assembleable onto opposite ends of said plenum tube, each said end cap comprising a wall having a central opening through which the projectile passes, said end cap wall extending from said central opening to said plenum tube;

a gas tube in fluid communication with said plenum, said gas tube having a first end and a second end; and a bored housing fixed to said firearm, wherein said gas tube extends at least partially into and is fixed within said bored housing.

2. The gas-actuated firearm of claim 1 wherein said bored housing is fixed to the plenum and wherein said gas tube extends from within said housing.

3. The gas-actuated firearm of claim 1 wherein the bored housing includes:

a first annular wall receiving said gas tube; and a second annular wall at least partially surrounding said barrel proximate to a receiver and said chamber end of said barrel.

4. The gas-actuated firearm of claim 3 wherein said second annular wall surrounds a barrel nut encompassing said barrel.

5. The gas-actuated firearm of claim 1 wherein said bored housing includes a first annular wall receiving said gas tube and a second annular wall at least partially surrounding a medial portion of said barrel.

6. The gas-actuated firearm of claim 1 wherein said bored housing is a receiver component of said firearm.

7. The gas-actuated firearm of claim 6 wherein said receiver component is a bored thermal break structure of the receiver.

8. The gas-actuated firearm of claim 1 wherein said bored housing is a bored thermal break structure of a firearm receiver.

9. The gas-actuated firearm of claim 1 wherein said gas tube is symmetrically constrained within said bored housing.

10. The gas-actuated firearm of claim 1 wherein said plenum tube, baffles, and end caps define a sound suppressor.

* * * * *